US011897588B2

(12) United States Patent
Decker

(10) Patent No.: US 11,897,588 B2
(45) **Date of Patent: *Feb. 13, 2024**

(54) WAKESURFING SYSTEMS AND METHODS

(71) Applicant: Sam Travis Decker, Spring Park, MN (US)

(72) Inventor: Sam Travis Decker, Spring Park, MN (US)

( * ) Notice: Subject to any disclaimer, the term of this patent is extended or adjusted under 35 U.S.C. 154(b) by 326 days.

This patent is subject to a terminal disclaimer.

(21) Appl. No.: 17/307,982

(22) Filed: May 4, 2021

(65) Prior Publication Data

US 2021/0253203 A1 Aug. 19, 2021

Related U.S. Application Data

(63) Continuation-in-part of application No. 16/850,584, filed on Apr. 16, 2020, now abandoned, which is a continuation of application No. 16/278,536, filed on Feb. 18, 2019, now Pat. No. 10,640,181.

(51) Int. Cl.
*B63B 34/67* (2020.01)
*B63B 21/56* (2006.01)

(52) U.S. Cl.
CPC ..... *B63B 34/67* (2020.02); *B63B 21/56* (2013.01); *B63B 2021/566* (2013.01)

(58) Field of Classification Search
CPC ..... B63B 34/00; B63B 34/67; B63B 21/00; B63B 21/56; B63B 2021/566
USPC ..... 114/254
See application file for complete search history.

(56) References Cited

U.S. PATENT DOCUMENTS

| | | | |
|---|---|---|---|
| 3,098,463 | A | 7/1963 | Brown |
| 3,178,127 | A | 4/1965 | Andersen |
| 3,195,831 | A | 7/1965 | Shriner |
| 3,303,813 | A | 2/1967 | Collins |
| 3,326,175 | A | 6/1967 | Baker |
| 3,498,563 | A | 3/1970 | Palmieri |
| 3,547,371 | A | 12/1970 | Gruseck |
| 3,831,545 | A | 8/1974 | Cain |
| 3,964,425 | A | 6/1976 | Septor |
| 4,304,372 | A | 12/1981 | Smith |
| 4,624,141 | A | 11/1986 | Soleau |
| 4,878,449 | A | 11/1989 | Smith |
| 4,938,725 | A | 7/1990 | Beck |

(Continued)

FOREIGN PATENT DOCUMENTS

WO 2011103568 A2 8/2011

*Primary Examiner* — Lars A Olson
(74) *Attorney, Agent, or Firm* — Gallium Law; Wesley Schwie; Michael Bakke

(57) ABSTRACT

The wakesurfing system may include a first and second reel assembly arranged and configured to retract a discarded surf rope. The second reel assembly may be replaced by a retraction device. The first reel assembly may have a telescoping and rotatable boom and may be coupled to a side of the watercraft. The second reel assembly or retraction device may be coupled to a rear portion of the watercraft. The first reel assembly may have a first reel cord coupled to a handle of the surf rope, and the second reel assembly may have a second reel cord coupled to a proximal location of the surf rope. The first reel cord and either second reel cord or retraction device, and the surf rope, may be in a retracted position when not in use, and in an extended position when used by a wakesurfer.

20 Claims, 22 Drawing Sheets

(56) References Cited

U.S. PATENT DOCUMENTS

| | | | | |
|---|---|---|---|---|
| 4,969,610 | A | 11/1990 | Taylor | |
| 5,632,219 | A | 5/1997 | Fleming | |
| 6,474,588 | B2 | 11/2002 | Valverde | |
| 6,505,573 | B1 | 1/2003 | Sheikholeslam | |
| 6,666,159 | B2 | 12/2003 | Larson | |
| 6,971,605 | B1 * | 12/2005 | Martin | B65H 75/4407 242/397.3 |
| 7,197,998 | B1 | 4/2007 | Rice | |
| 7,334,808 | B2 * | 2/2008 | Fatzinger | B63B 34/67 114/253 |
| 7,665,411 | B2 | 2/2010 | Welch | |
| 8,220,405 | B2 | 7/2012 | Christensen | |
| 8,522,706 | B2 | 9/2013 | Larson | |
| 9,108,706 | B2 | 8/2015 | Doerr | |
| 9,592,890 | B2 | 3/2017 | Christensen | |
| 10,640,181 | B1 | 5/2020 | Decker | |
| 2006/0027155 | A1 | 2/2006 | Welch | |
| 2007/0023557 | A1 | 2/2007 | Rankin | |
| 2008/0054118 | A1 | 3/2008 | Czajkowski | |
| 2011/0143846 | A1 | 6/2011 | Davis | |
| 2012/0060740 | A1 | 3/2012 | Stevens | |
| 2012/0132121 | A1 | 5/2012 | Scheper | |
| 2015/0014379 | A1 | 1/2015 | Jesewitz | |
| 2020/0262523 | A1 | 8/2020 | Decker | |

* cited by examiner

WAKESURFING SYSTEMS AND METHODS

BACKGROUND

Field

Various embodiments disclosed herein relate to wakesurfing systems. Certain embodiments relate to reel assemblies for wakesurfing systems.

Description of Related Art

Wakesurfing is a water sport where an individual uses a wakesurfing board to surf the wake created by a boat. To begin wakesurfing, a person typically enters the water behind the boat and holds onto a surf rope attached to the boat. As the boat accelerates, the rider is pulled to a standing position atop the wakesurfing board, at which point the rider releases the surf rope and begins surfing the wake. The sport is quickly gaining popularity but is faced by one major issue: how to best deal with the surf rope both before and after it is released by a rider. The two presently existing solutions are using an additional person to distribute and collect the discarded rope or leave the rope in the water during the ride. The use of a person to collect the rope is only an option when an additional person is present, thus requiring at least two people present on the boat at all times. Leaving the surf rope in the water during the ride brings a host of potential issues, including wear/damage to the rope, rope drag interfering with the wake, and the possibility of the rope getting caught in the propeller and causing serious damage to the watercraft. Therefore, there is a need for a solution to address the shortcomings as described above.

SUMMARY

The current invention advances the sport of wakesurfing in a novel way by facilitating retraction of the surf rope after it is released by the wakesurfer.

This disclosure includes a variety of wakesurfing system embodiments. Some embodiments may include a wakesurfing system comprising a first reel assembly arranged and configured to couple to a first location on a watercraft and a second reel assembly arranged and configured to couple to a second location on the watercraft. The first reel assembly may have a first reel cord having a first end arranged and configured to couple to the first reel assembly and a second end arranged and configured to couple to a distal location of a surf rope, wherein the distal location may be located adjacent to a handle of the surf rope. The second reel assembly may have a second reel cord having a first end arranged and configured to couple to the second reel assembly and a second end arranged and configured to couple to a proximal location of the surf rope, wherein the proximal location may be between the distal location and the second reel assembly.

The wakesurfing system solves the aforementioned issue of how to handle a discarded surf rope by using the first and second reel assemblies to "pull in" (retract) the surf rope after it is released by a rider. In some embodiments, the first reel assembly may be arranged and configured to retract the handle of the surf rope back so that the handle is adjacent the first reel assembly, and therefore no longer in the water. In some embodiments the second reel assembly may be arranged and configured to retract the proximal location of the surf rope back so that the proximal location is adjacent the second reel assembly and the surf rope is not located along a side or rear surface of the watercraft. The retraction of the handle and proximal location of the surf rope results in the surf rope being pulled out of the water so that it is no longer at risk of damage, getting caught in the propeller, or interfering with the wake of the watercraft.

In some embodiments, the first reel assembly may be coupled to a first location and the second reel assembly may be coupled to a second location on a watercraft, wherein the first location may be a cleat located on the watercraft and the second location may be a tower extending above the watercraft. In many embodiments the cleat may be located on the side of the watercraft, thus, described differently, the first reel assembly may be arranged and configured to be closer to a water surface than the second reel assembly. In some embodiments the first reel assembly may comprise a clamp arranged and configured to couple to the cleat, thus coupling the first reel assembly as a whole to the watercraft. Many embodiments of the wakesurfing system may be compatible with various types of boat cleats, including static and folding cleats. According to some embodiments, the wakesurfing system comprises an attachment mechanism for coupling to the watercraft. The attachment mechanism may be a speed tow hook, at least one suction cup, hook-and-loop fasteners, a mounting plate, a trailering eye, ski pylon, or a swim platform.

In some embodiments, the first reel assembly may comprise a boom arranged and configured to allow the first reel cord to pass through an internal or external portion of the boom. The boom may comprise one or more guides located along a length of the boom to thereby guide the first reel cord through the boom and may further comprise one or more rollers located at a distal end of the boom to thereby guide the first reel cord out and away from the distal end of the boom. The guides and rollers may also act to protect the first reel cord from wear that could result from rubbing against the internal portion and/or distal end of the boom, as well as prevent the first reel cord from twisting within the boom.

In many embodiments the boom may be arranged and configured to telescope such that when the boom is in an elongated position the boom defines a first length and when the boom is in a retracted position the boom defines a second length that is shorter than the first length, such that the length of the boom may vary from three to five feet depending on the level of elongation or retraction. In many embodiments the boom may define a length of about four feet. In some embodiments the boom may define a length not between three and five feet, and may instead be shorter or longer. The boom may be arranged and configured to extend perpendicular to the side of the watercraft in many embodiments, and the first reel assembly may comprise a first pivot mechanism located along a proximal portion of the first reel assembly. In some embodiments, the first pivot mechanism may be arranged and configured to allow for a plurality of rotation positions of the first reel assembly. For example, the first pivot mechanism may be arranged and configured to rotate the first reel assembly and boom upward so that the first reel assembly protrudes up and away from the watercraft. In many embodiments, the first reel assembly may be arranged and configured to rotate along a first axis and the second reel assembly may be arranged and configured to rotate along a second axis that is different than the first axis. This rotation feature may be useful to watercraft operators for greater ease of storage when the watercraft is not in use, as well as allowing the first reel assembly to remain coupled to the watercraft when the watercraft is not being used for wakesurfing.

In some embodiments, the first reel assembly comprises a first spring reel and the second reel assembly comprises a second spring reel. In some embodiments the first spring reel may produce a tension of about five pounds on the first reel cord.

In some embodiments, the first reel assembly is arranged and configured to be coupled to the first location on the watercraft by a torsion bar assembly. The torsion bar assembly may be arranged and configured to extend vertically from the first location on the watercraft, thereby creating a vertical axis about which the first reel assembly and the boom may rotate.

According to some embodiments, the torsion bar assembly configures a first ball joint to allow free rotation of the first reel assembly and the boom. The torsion bar assembly may comprise a post coupled to the first ball joint through a quick disconnect from post, which may allow for rapid detachment of the post from the first ball joint. In some embodiments, the torsion bar assembly comprises a double ball joint assembly coupled to the post at an end opposite that of the first ball joint, configured to rotate about the vertical axis of the torsion bar assembly and assist with the free rotation of the first reel assembly and the boom. According to some embodiments, a base is coupled to the double ball joint assembly at an end opposite the post through the use of a quick connect to base for rapid attachment of the base and double ball joint assembly.

In some embodiments, the post of the torsion bar assembly comprises a torsion spring to allow the first reel assembly and the boom to rotate toward the rear of the watercraft, but when returning to their original position, the torsion spring stops the first reel assembly and the boom from rotating past a location where they are at least partially perpendicular to the side of the watercraft. According to some embodiments, the post comprises a plastic sleeve inserted into the top end of the post. A shaft may be inserted through the bottom end of the post. The shaft may comprise a torsion spring stop which may prevent the torsion spring from entering the post too deeply. In some embodiments, a torsion spring lock is coupled to the bottom of the post and locks the torsion spring into place.

The base assembly of the wakesurfing system may comprise a cam handle that is inserted through the base assembly. In some embodiments, a plate is coupled to the cam handle on the opposite side of the base assembly. According to some embodiments, the plate comprises at least one slot. At least one eyelet may be coupled to the plate by attaching to the at least one slot. The at least one eyelet may be configured to attach to the cleat of the watercraft to mount the torsion bar assembly. In some embodiments, the plate comprises an eye tensioner configured to pull the at least one eyelet inward toward the middle of the plate, and by proxy, the middle of the cleat. In these embodiments, this eye tensioner would hold the base assembly at least partially in place.

According to some embodiments, the wakesurfing system uses a first reel assembly and a retraction device such as a bungee cord or slack device to "pull in" (retract) the surf rope after it is released by a rider. In some embodiments, the retraction device is coupled to a rear of the watercraft. The first reel assembly may be arranged and configured to retract the handle back so that the handle is adjacent with the first reel assembly. According to some embodiments, the retraction device is arranged and configured to retract the proximal location of the surf rope back so that the proximal location is adjacent the retraction device and the surf rope is not located in the water along a side or rear surface of the watercraft.

In some embodiments, a wakesurfing system comprises a first reel assembly arranged and configured to couple to a first location on a watercraft, a first reel cord having a first end arranged and configured to couple to the first reel assembly and a second end arranged and configured to couple to a distal location of a surf rope, and a boom coupled to the first reel assembly. The boom may be arranged and configured to allow the first reel cord to pass through an internal portion of the boom.

In some embodiments, the system further comprises a torsion bar assembly. Accordingly, the first reel assembly may be arranged and configured to be coupled to the first location on the watercraft via the torsion bar assembly. Furthermore, the torsion bar assembly may be arranged and configured to extend vertically from the first location on the watercraft, thereby creating a vertical axis extending from the first location on the watercraft. In some embodiments, the first reel assembly is configured to rotate about the vertical axis of the torsion bar assembly.

In some embodiments, the torsion bar assembly further comprises a first ball joint configured to rotate about the vertical axis of the torsion bar assembly, a post coupled to the first ball joint, and a quick disconnect operably coupled to the first ball joint and detachably coupled to the post, whereby the quick disconnect is configured to detach the first ball joint from the post. The torsion bar assembly may also include a double ball joint assembly coupled to the post on an end opposite that of the first ball joint, whereby the double ball joint assembly is configured to rotate about the vertical axis of the torsion bar assembly. In some embodiments, the double ball joint permits more freedom of movement. The torsion bar assembly may also include a base assembly coupled to the double ball joint assembly on an end opposite that of the post, and a quick connect operably coupled to the double ball joint assembly and detachably coupled to the base assembly, whereby the quick connect is configured to attach the double ball joint assembly to the base assembly.

In some embodiments, the post further comprises a plastic sleeve configured to be inserted into the post, and a shaft configured to be inserted into the post on an end opposite that of the plastic sleeve, wherein the shaft comprises a torsion spring stop. The post may also include a torsion spring configured to be inserted into the post at least partially about the shaft and configured to stop entering the post when making contact with the torsion spring stop, and a torsion spring lock configured to lock the torsion spring in place and couple to the post.

In some embodiments, the base assembly further comprises a cam handle configured to be inserted through the base assembly, a plate coupled to the cam handle wherein the plate comprises at least one slot, at least one eyelet coupled to the plate through the at least one slot, wherein the at least one eyelet is arranged and configured to couple to a cleat of the watercraft, and an eye tensioner configured to pull the at least one eyelet inward toward a center of the plate, thereby putting tension on the at least one eyelet arranged and configured to couple to the cleat to hold the base assembly at least partially in place.

The wakesurfing system may also comprise a second reel assembly arranged and configured to couple to a second location on the watercraft, and a second reel cord having a first end arranged and configured to couple to the second reel assembly and a second end arranged and configured to couple to a proximal location of the surf rope. In some embodiments, the distal location of the surf rope is located adjacent to a handle of the surf rope, and wherein the proximal location is between the distal location and the second reel assembly. In some embodiments, the first reel assembly and the second reel assembly are arranged and configured to retract during and after a rider releases the surf rope.

In some embodiments, when the watercraft is located in a body of water, the second reel assembly is arranged and configured to retract the proximal location of the surf rope back so that the proximal location is adjacent the second reel assembly and that the surf rope is not located in the water along a side or rear surface of the watercraft. In some embodiments, the first reel assembly is arranged and configured to rotate along a first axis and the second reel assembly is arranged and configured to rotate along a second axis that is different than the first axis.

In some embodiments, the wakesurfing system further comprises a retraction device arranged and configured to couple to a second location on the watercraft. In some embodiments, the first reel assembly and the retraction device are arranged and configured to retract after a rider releases the surf rope.

In some embodiments, the first reel assembly is arranged and configured to retract the handle back so that the handle is adjacent the first reel assembly after the rider releases the surf rope. In some embodiments, when the watercraft is located in a body of water, the retraction device may be arranged and configured to retract the proximal location of the surf rope back so that the proximal location is adjacent the second location on the watercraft and that the surf rope is not located in the water along a side or rear surface of the watercraft.

In some embodiments, the first location is a cleat located on the watercraft and the second location is located at a rear of the watercraft. In some embodiments, the boom comprises one or more guides located along a length of the boom to thereby guide the first reel cord through the boom.

In some embodiments, the boom comprises one or more rollers located at a distal end of the boom to thereby guide the first reel cord out and away from the distal end of the boom. The boom may be arranged and configured to telescope such that when the boom is in an elongated position the boom defines a first length and when the boom is in a retracted position the boom defines a second length that is shorter than the first length.

The wakesurfing system may further comprise an attachment mechanism arranged and configured to couple the first reel assembly to the watercraft.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments. Various components in the drawings may not be drawn to scale.

DETAILED DESCRIPTION

Figure 1A:
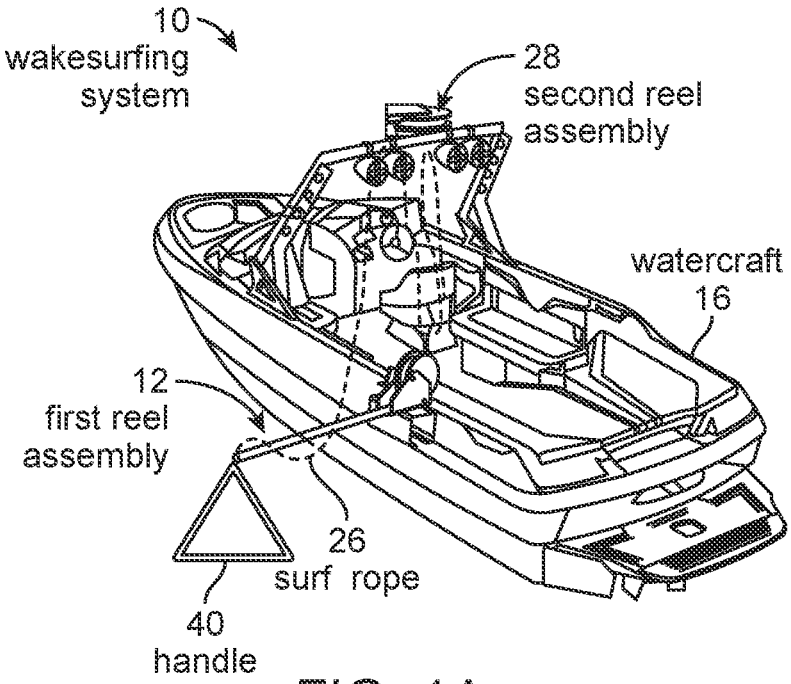
FIG. 1A illustrates a perspective view of a wakesurfing system wherein the reel cords and surf rope are in a retracted position, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any system or device disclosed herein, the acts or operations of the system or device may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, methods, and/or procedures described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

INDEX OF COMPONENTS

10—Wake surfing system
12—First reel assembly
14—First location
16—Watercraft
18—First reel cord
20—First end
22—Second end
24—Distal location
26—Surf rope
28—Second reel assembly
29—Retraction device
30—Second location
32—Second reel cord
34—First end
36—Second end
38—Proximal location
40—Handle
42—Side
44—Rear
46—Cleat
48—Tower
50—Boom
52—Internal portion
54—First length
56—Second length
58—First pivot mechanism
60—Proximal portion
62—Clamp
64—One or more guides
66—One or more rollers
68—Distal end
70—First spring reel
72—Second spring reel
74—First axis
76—Second axis
78—Water surface
80—Torsion bar assembly
82—First ball joint
84—Quick disconnect from post
86—Post
88—Torsion spring
90—Plastic sleeve
92—Torsion spring stop
94—Torsion spring lock
96—Shaft
98—Double ball joint assembly
100—Quick connect to base
102—Base assembly
104—Cam handle
106—At least one eyelet
108—Plate
110—Eye tensioner
112—At least one slot
114—Attachment mechanism Introduction Traditional wakesurfing practices involve having an extra person on the boat to pull in the discarded surf rope or simply leaving the rope in the water during the duration of the ride. A rope left in the water causes numerous problems for the boat driver and the rider, including creating drag that interferes with the wake and the quality of the ride, and, more dangerously, getting caught in the boat's propeller. Both of these potential issues can significantly impact the wakesurfing experience for the driver and rider, and the previous solution required the presence of an additional person to pull in the rope. The wakesurfing system of this application solves the problems of the surf rope in wakesurfing without requiring an additional person, thereby allowing more freedom for wakesurfing enthusiasts to enjoy their sport. Additionally, the system described herein is configured to present the rope to the rider without the assistance of another person. As such, this greatly decreases the time to restart the rider after a falling, etc. Various embodiments herein describe a system comprising multiple reel assemblies that operate to retract the discarded surf rope from the water surface during a ride.

System Embodiments

Figure 1B:
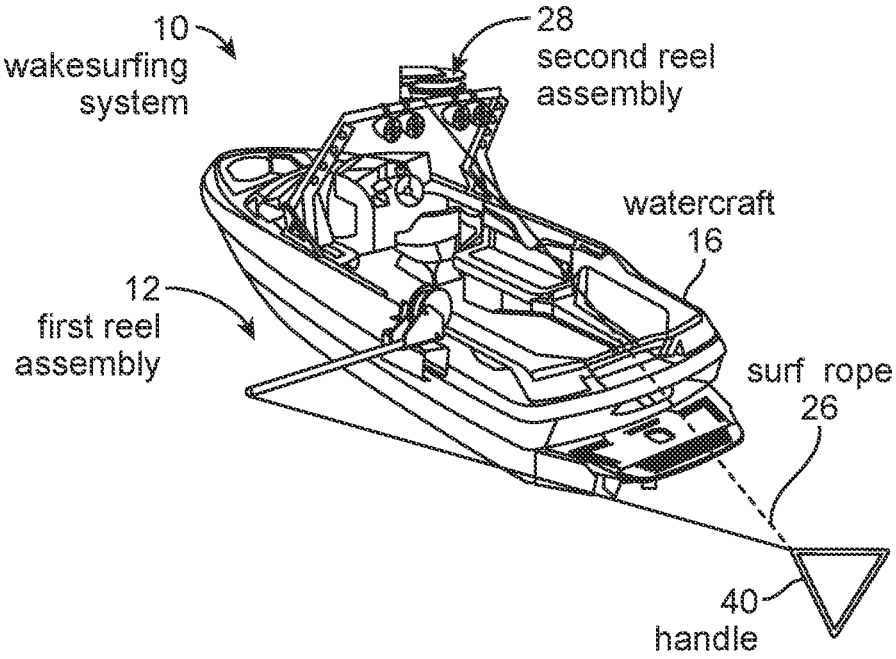
FIG. 1B illustrates a perspective view of a wakesurfing system wherein the reel cords and surf rope are in an extended position, according to some embodiments.

FIGS. 1A and 1B illustrate wakesurfing system 10. As shown, the system 10 may include a first reel assembly 12 and a second reel assembly 28, as well as a watercraft 16, a surf rope 26, and a handle 40. In some embodiments, the handle 40 may comprise a triangle shape, but in other embodiments may comprise any other suitable shape and/or form. In some embodiments, the watercraft 16 may comprise a variety of boats and/or vessels suitable for water sports.

FIG. 1A illustrates the system 10 in a retracted position and FIG. 1B illustrates the system 10 in an extended position, as it would be when a rider is holding on to the surf rope 26. FIG. 1A shows the handle 40 adjacent to the first reel assembly 12 and the surf rope 26 out of the water, thus not at risk of getting caught in the propeller or creating drag and interfering with the wake. In some embodiments, the retracted position may comprise the surf rope gathered in the boat or suspended over the watercraft, depending on the length of the surf rope and extent of retraction. It should be appreciated that the rope 26 may be configured to provide a safe distance to carry the rider behind the watercraft 16. In some embodiments, the surf rope 26 and handle 40 may move into the retracted position of FIG. 1A when the rider drops the surf rope 26 after successfully standing up on his or her wakeboard and beginning to wakesurf. In some embodiments the driver may activate retraction. Alternatively, retraction may be activated after a predetermined amount of time has passed following release of the surf rope 26 by the rider. A sensor(s) of the wakesurfing system 10 may recognize release of the surf rope 26 by a decrease in tension on the surf rope 26, in some embodiments. A spring mechanism of the system 10 may facilitate retraction, in some embodiments. In some embodiments the system 10 may be released from retraction and allowed to extend after a rider falls and/or to start another ride. In some embodiments, the retraction is accomplished via an electric motor, an engine, hydraulics, and the like. The surf rope 26 may be attached to the tower 48 of the watercraft 16, the rear 44 of the watercraft 16, or the cleat 46 of the watercraft 16.

Figure 2:
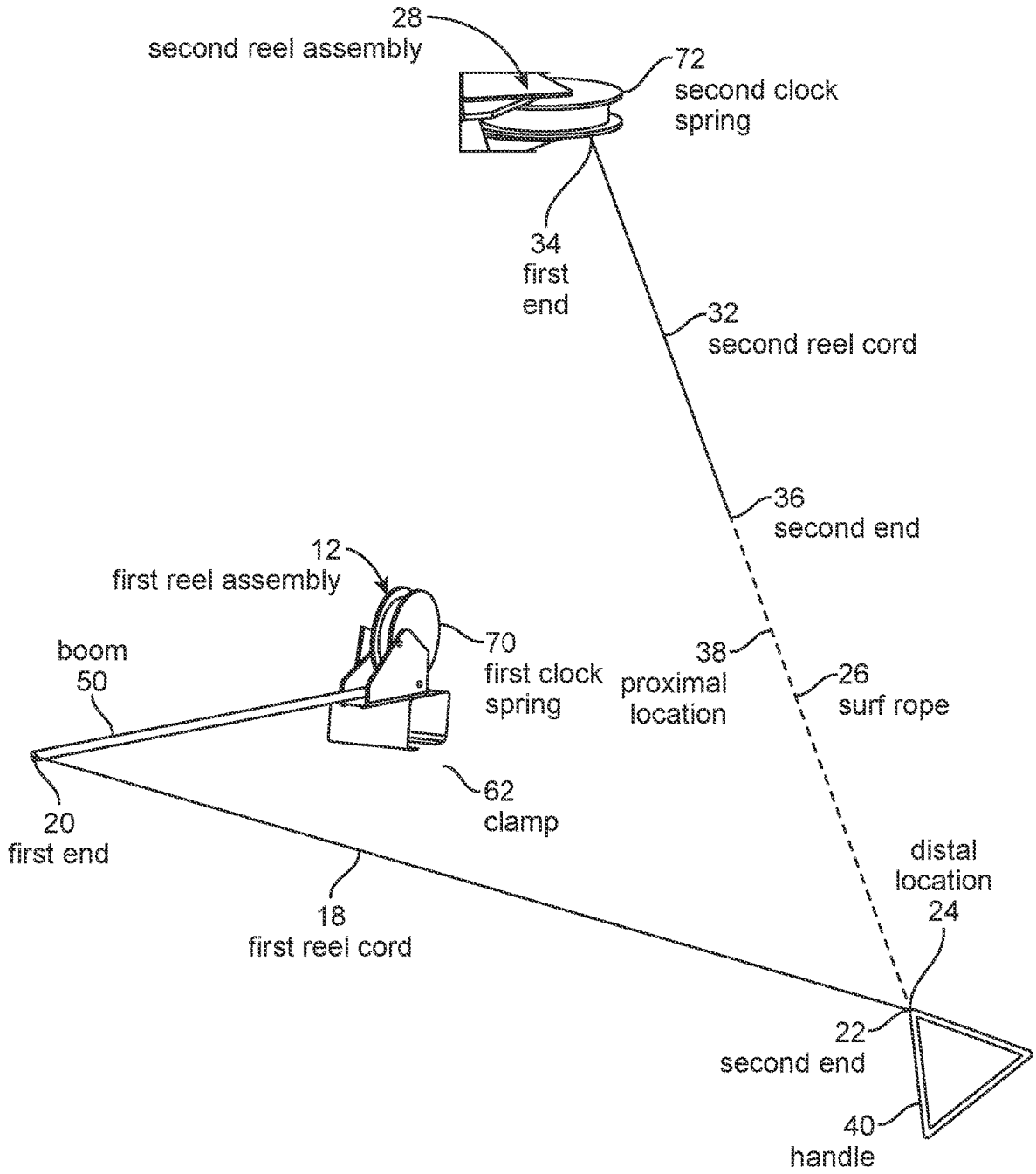
FIG. 2 illustrates a perspective view of both reel assemblies, both reel cords, and the surf rope, according to some embodiments.

FIG. 2 illustrates, in greater detail, the relationship between the first reel assembly 12, the second reel assembly 28, and the surf rope 26. In some embodiments, the first reel assembly 12 may comprise a first spring reel 70, a clamp 62, a boom 50, and a first reel cord 18. In some embodiments, the second reel assembly 28 may comprise a second spring reel 72 and a second reel cord 32. The first reel cord 18 may comprise a first end 20 and a second end 22, wherein the first end 20 may be adjacent to the first reel assembly 12 and the second end 22 may be adjacent a distal location 24 of the surf rope 26. In some embodiments, the distal location 24 may be adjacent the handle 40 of the surf rope 26. In some other embodiments, the distal location 24 may be a location on the handle 40. The second reel cord 32 may comprise a first end 34 adjacent to the second reel assembly 28 and a second end 36 adjacent a proximal location 38 of the surf rope 26. In some embodiments, the second end 36 may be coupled to the proximal location 38. In some embodiments, the first reel assembly 12 may be arranged to retract distal location 24 and/or the handle 40 and the second reel assembly 28 may be arranged to retract a proximal location 38 of the surf rope 26 at an appropriate time and/or situation, thus pulling the handle 40 and surf rope 26 up and out of the water. It should also be appreciated that either the first reel assembly 12 and/or the second reel assembly 28 may be coupled at any location on the watercraft 16, such as the top of the tower, a pylon near the stern of the watercraft, ski hook located on the stern of the watercraft 16, and/or a cleat 46.

In some embodiments when the wakesurfing system 10 is in an extended position, the first reel cord 18 and second reel cord 32 may not be fully extended. That is to say, the first reel cord 18 may not be virtually completely unwound from the first spring reel 70, and the second reel cord 32 may not be virtually completely unwound from the second spring reel 72, in some embodiments. In some embodiments the first reel cord 18 and second reel cord 32 may be wound and/or unwound from the first spring reel 70 and the second spring reel 72, respectively, in order to adjust the length of the surf rope 26 available to the rider. The ability to adjust the length of available surf rope 26 may be important for use of the system 10 with different types and/or sizes of boats and ropes. For example, some boats may require a longer length of surf rope 26 to get a rider to the "sweet spot" of the wake, and the ability to "let out" more or pull in excess rope via the spring reels 70 and 72 allows the system 10 to adapt to a multitude of possible watercrafts and ropes.

Figure 3A:
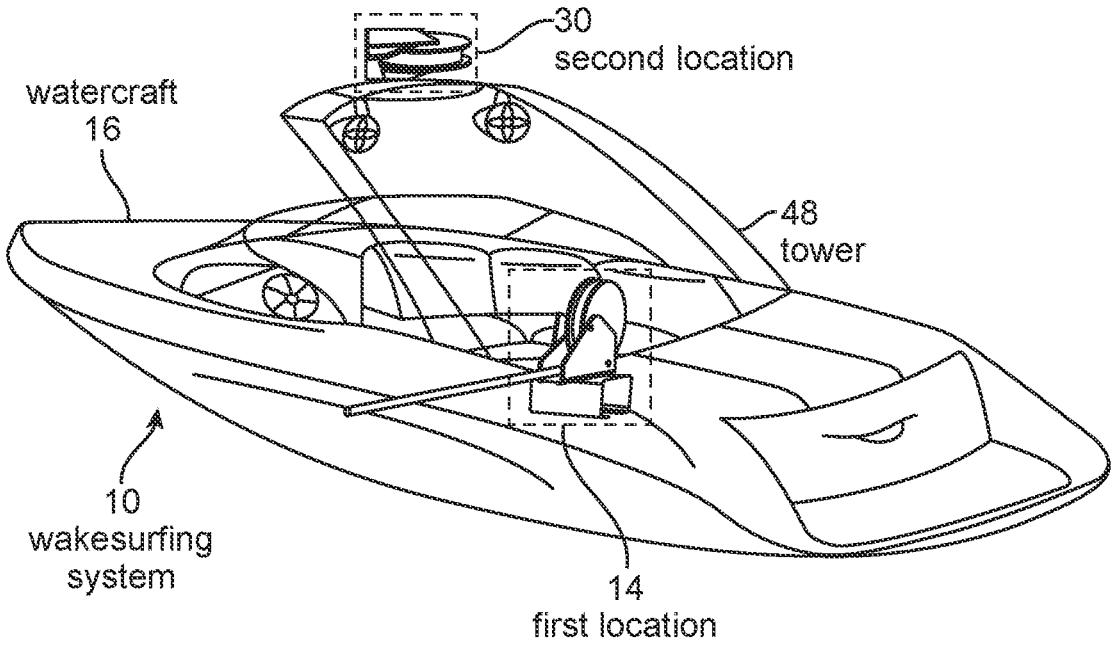
FIG. 3A illustrates a perspective view of a wakesurfing system with a first and second location, according to some embodiments.
Figure 3B:
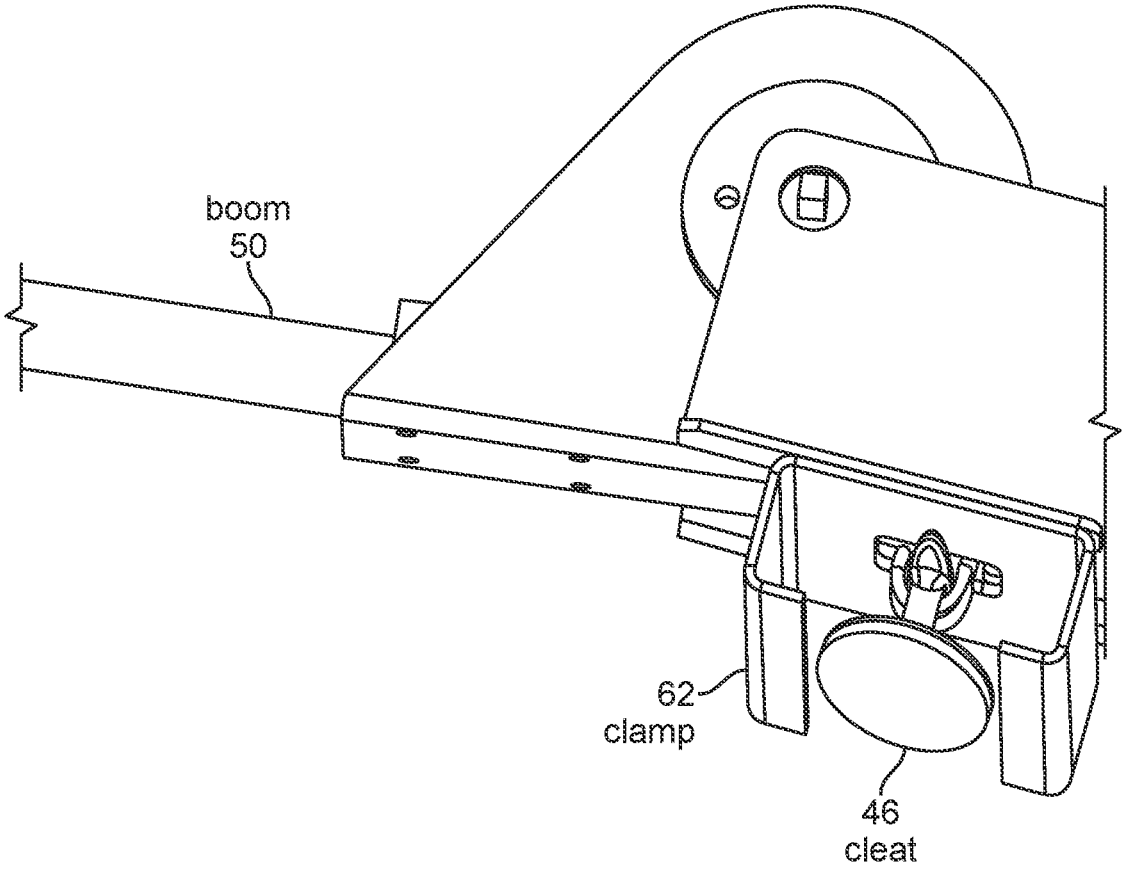
FIG. 3B illustrates a bottom perspective view of the first location with a boat cleat and the first reel assembly, according to some embodiments.
Figure 6:
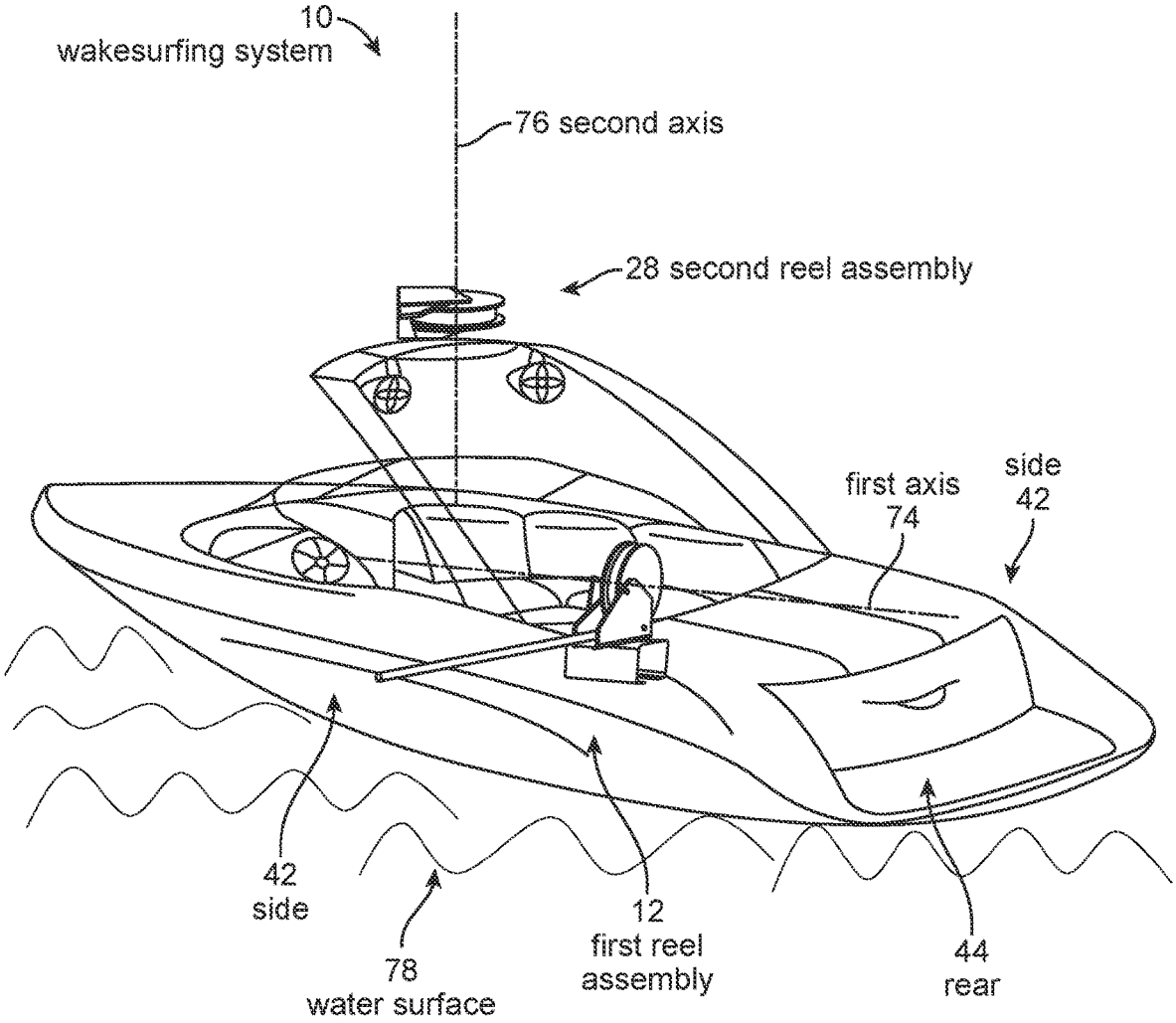
FIG. 6 illustrates a perspective view of the wakesurfing system with axes drawn to illustrate rotation of the reel assemblies, according to some embodiments.

FIG. 3A illustrates the first location 14 and second location 30 of the wakesurfing system 10, wherein the first location 14 is the area of attachment for the first reel assembly 12 and the second location 30 is the area of attachment for the second reel assembly 28. In many embodiments, the first location 14 is located on the side 42 of the watercraft 16, and the second location 30 is the tower 48 of the watercraft 16. In other embodiments, the first location 14 is located somewhere other than the side 42 of the watercraft 16, including the back of the watercraft 16 or the tower 48 of the watercraft 16. In further embodiments, the second location 30 is located somewhere other than the tower 48 of the watercraft 16, including the rear 44 of the watercraft 16 or a side 42 of the watercraft 16. FIG. 3B shows the first location 14 in greater detail and illustrates that, in many embodiments, a clamp 62 of the first reel assembly 12 may be arranged and configured to couple to a cleat 46 located on the watercraft 16, thus coupling the first reel assembly 12 to the watercraft 16. In some embodiments the cleat 46 may be a static cleat; alternatively, the cleat 46 may be a foldable cleat. As shown by FIG. 3A, in many embodiments the first reel assembly 12 may be arranged and configured to be closer to a water surface than the second reel assembly 28. Though FIG. 3A, as well as FIGS. 1A, 1B, and 6, depict the first reel assembly 12 coupled to the port side of the watercraft 16, in some embodiments the first reel assembly 12 may couple to the starboard side of the watercraft 16.

Figure 4A:
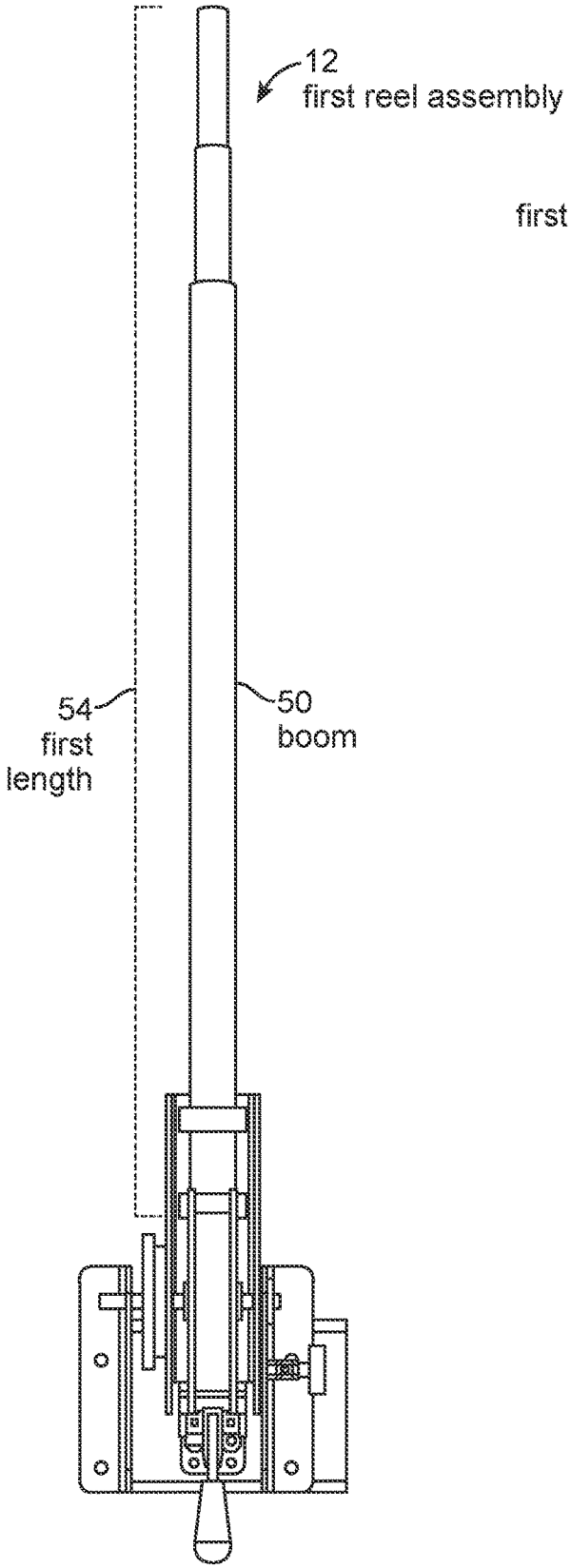
FIG. 4A illustrates a top perspective view of the first reel assembly and boom in an elongated position, according to some embodiments.
Figure 4B:
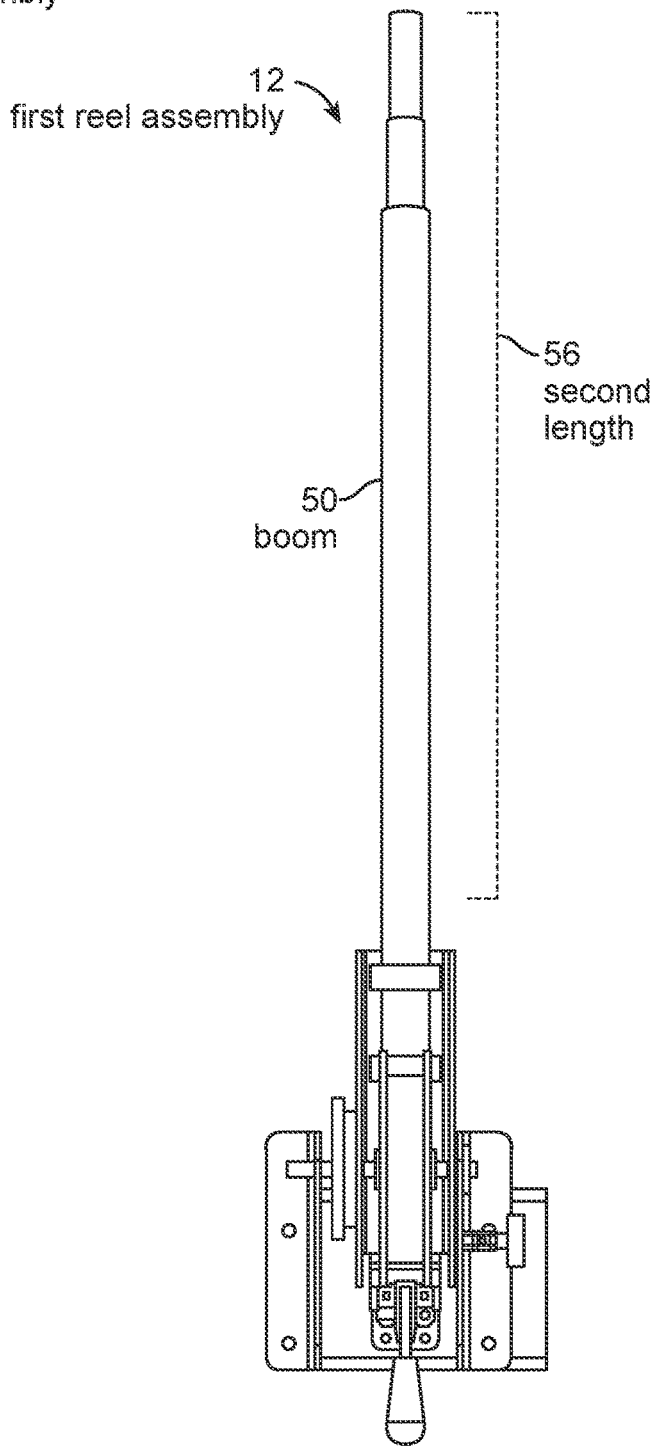
FIG. 4B illustrates a top perspective view of the first reel assembly and boom in a retracted position, according to some embodiments.

FIGS. 4A and 4B illustrate top perspective views of the telescoping boom 50 in an elongated and retracted position, respectively. When in an elongated position the boom 50 may define a first length 54 and when in a retracted position the boom 50 may define a second length 56. In some embodiments the boom 50 may define a length between three and five feet depending on level of elongation or retraction, however, three to five feet is not the only possible length range of the boom 50 in other embodiments. In some embodiments, the boom telescopes to thereby lengthen and shorten to the user's desired length. In some embodiments, the boom 50 comprises one, two, or more different segments that are coupled together to form the boom 50. In this manner, the boom 50 may be bisected. Additionally, the boom 50 may be configured to detach from the watercraft 16. However, it should be appreciated that this is one of many ways the boom may be configured to lengthen and shorten. For example, the boom may comprise separate pieces that can be threadably coupled together to meet the user's desired length. Alternatively, the boom may comprise foldable sections, which can be folded on top of each other to shorten the boom length or unfolded to lengthen the boom.

Figure 5A:
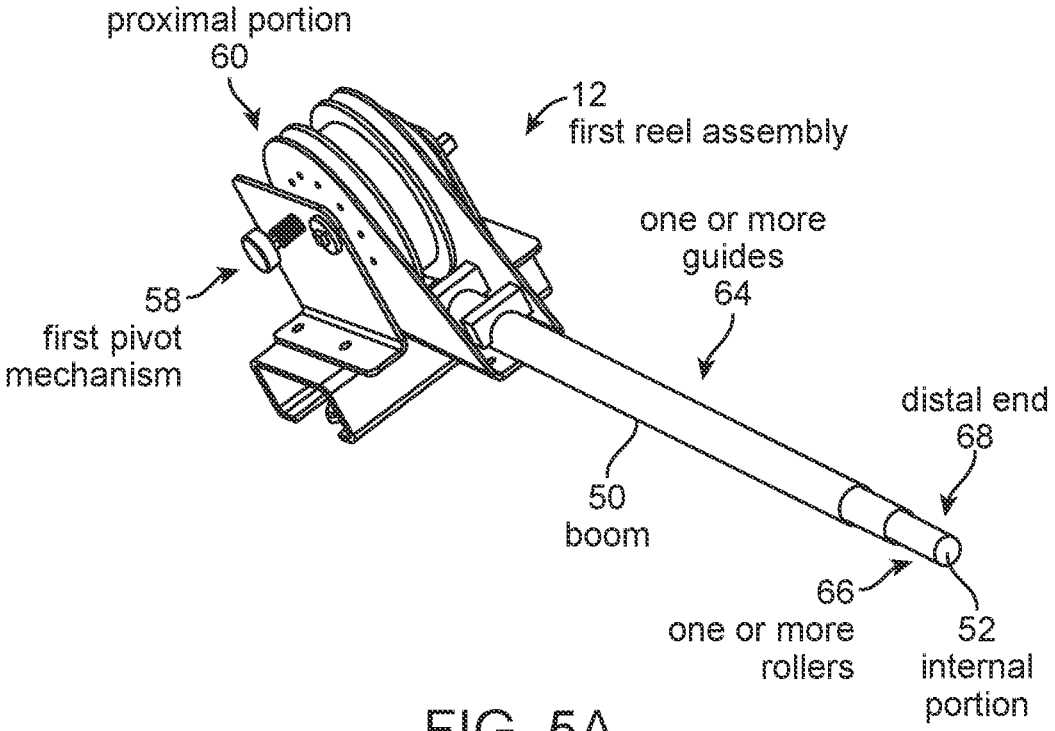
FIG. 5A illustrates an angled side perspective view of the first reel assembly, according to some embodiments.
Figure 5B:
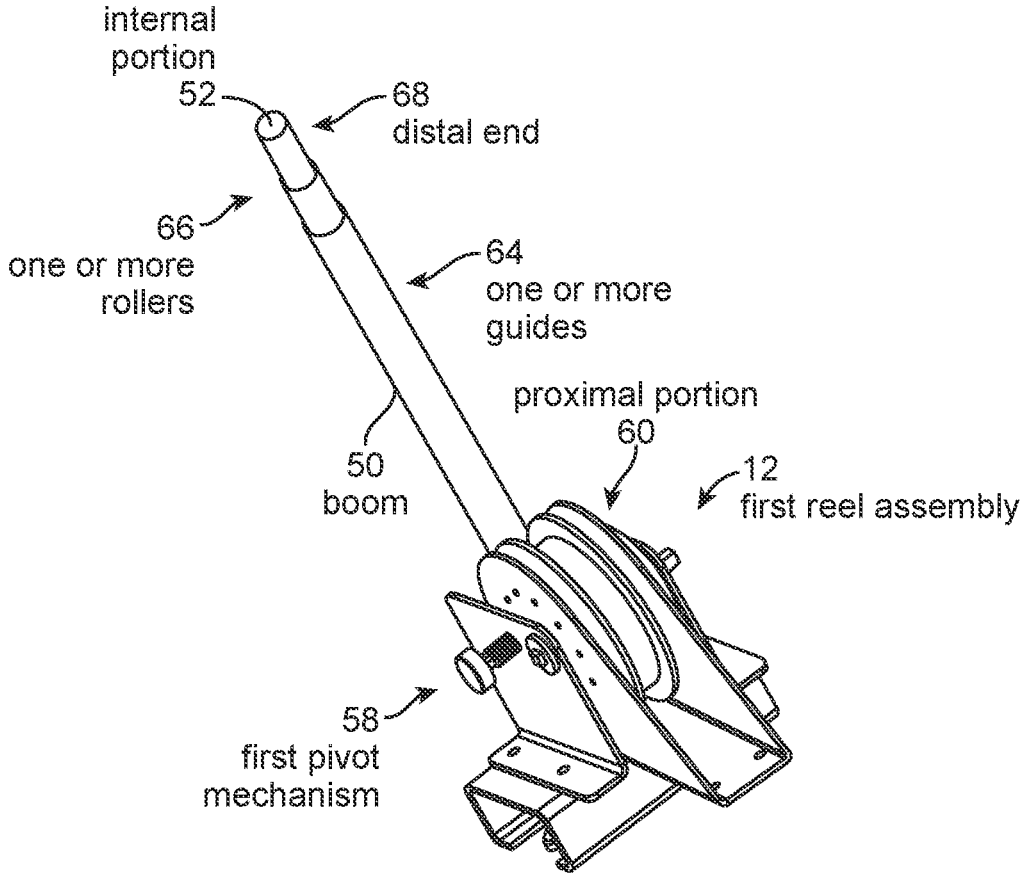
FIG. 5B illustrates a side perspective view of the first reel assembly wherein the first reel assembly and boom are rotated upward, according to some embodiments.

FIGS. 5A and 5B illustrate the rotation ability of the first reel assembly 12, as well as more detail of the components of the boom 50. FIG. 5A shows the boom 50 in a position wherein when the first reel assembly 12 is coupled to the watercraft 16, the boom 50 would extend perpendicular to the side 42 of the watercraft 16, as shown in FIGS. 1A, 1B, 3A, and 6. FIG. 5B shows the first reel assembly 12 rotated so that the boom 50 points upward for greater ease of storage when the first reel assembly 12 is not in use. Alternatively, the boom 50 may be rotated to achieve different angles between the first reel cord 18 and the second reel cord 32, so as to impact the wakesurfing experience for the rider. For example, a rotation position closer to perpendicular to the side 42 of the watercraft 16 may position a rider a different location in the wake than a rotation position that points the boom 50 closer to upward than perpendicular. Rotation is achieved through use of the first pivot mechanism 58, which is shown in FIG. 5A. In some embodiments, the first pivot mechanism 58 may allow for a number of rotation positions, for example, 30°, 60°, 90°, or any other appropriate angle between the boom 50 and the watercraft 16. In some embodiments, the knob component of the first pivot mechanism 58, shown in FIG. 5A, is spring loaded. In some embodiments it may be necessary to unspool the first reel cord 18 from the first spring reel 70 prior to rotation.

FIG. 5A also illustrates that in some embodiments, the boom 50 is hollow to allow the first reel cord 18 to feed through the boom 50 and extend out through the distal end 68. In some embodiments, the first reel cord 18 may exit the distal end 68 at any angle to the distal end 68. For example, the first reel cord 18 may continue straight out of the distal end 68, or the first reel cord 18 may exit at an angle to meet the surf rope 26 and rider at a position at some angle to the boom 50. The distal end 68 may comprise one or more rollers 66 to protect the first reel cord 18 from wear as it extends through the distal end 68, as well as to guide the first reel cord 18 through the boom 50. The internal portion 52 of the boom 50 may comprise one or more guides 64 to help feed the first reel cord 18 through the boom 50, as well as to protect the first reel cord 18 from wear. In some embodiments, the first reel cord 18, second reel cord 32, and/or the surf rope 26 may pass through the internal portion 52 of the boom 50 or an external portion of the boom 50.

FIG. 6 illustrates a perspective view of the wakesurfing system 10 and the axes of rotation for the first reel assembly 12 and the second reel assembly 28. The first reel assembly 12 rotates around a first axis 74, which, in some embodiments, may be the axis traditionally considered the X-axis. The second reel assembly 28 rotates around a second axis 76, which, in some embodiments, may be the axis traditionally considered the Y-axis. FIG. 6 also illustrates greater details of the watercraft 16, including a rear 44 and two possibilities for a side 42. FIG. 6 also illustrates a water surface 78, which may be a lake, ocean, river, or any other suitable body of water.

In some embodiments various components of wakesurfing system 10 may be constructed from metal, hard plastic, or any other durable and/or suitable material. The first reel cord 18 and second reel cord 32, as well as the surf rope 26, may be cylindrical cords and/or ropes in some embodiments. Alternatively, the reel cords 18 and 32 and surf rope 26 may be flat straps or any other suitable composition. In some embodiments, the first reel cord 18, second reel cord 32, and surf rope 26 may or may not all be composed of the same material.

Figure 7:
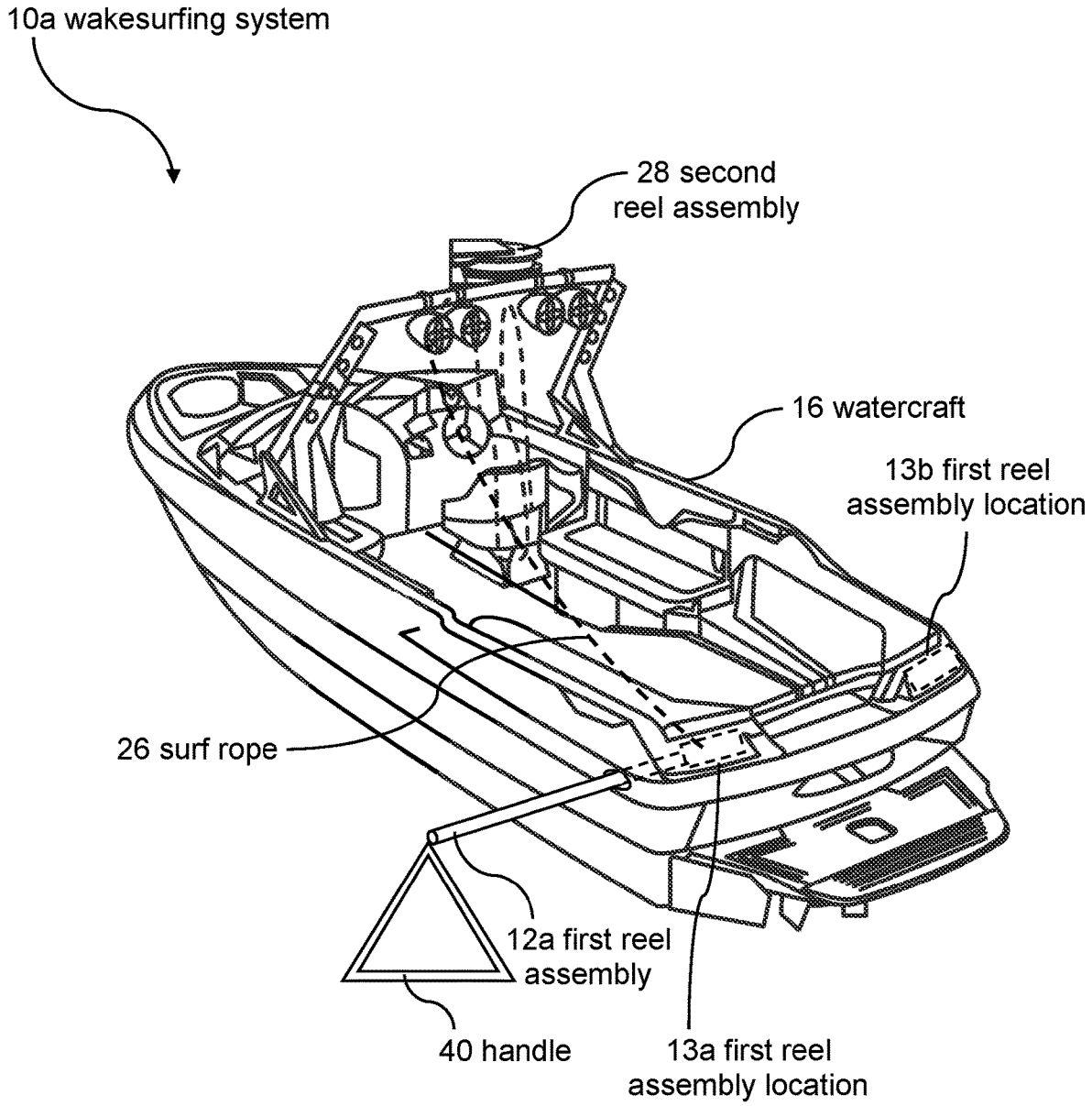
FIGS. 7-9 illustrate perspective views of other wakesurfing systems with the first reel assembly located in various locations on the watercraft, according to some embodiments.
Figure 8:
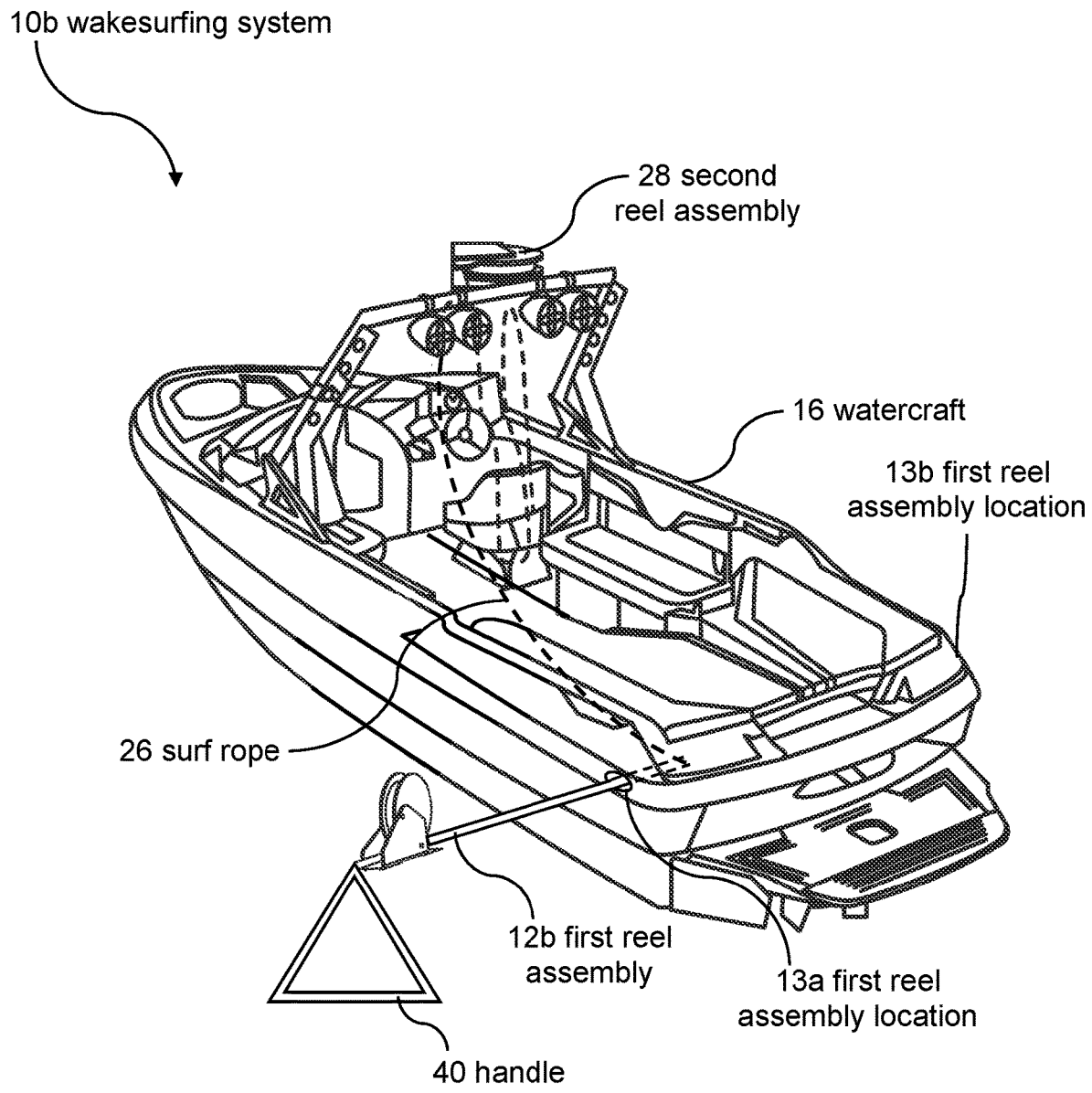
Figure 9:
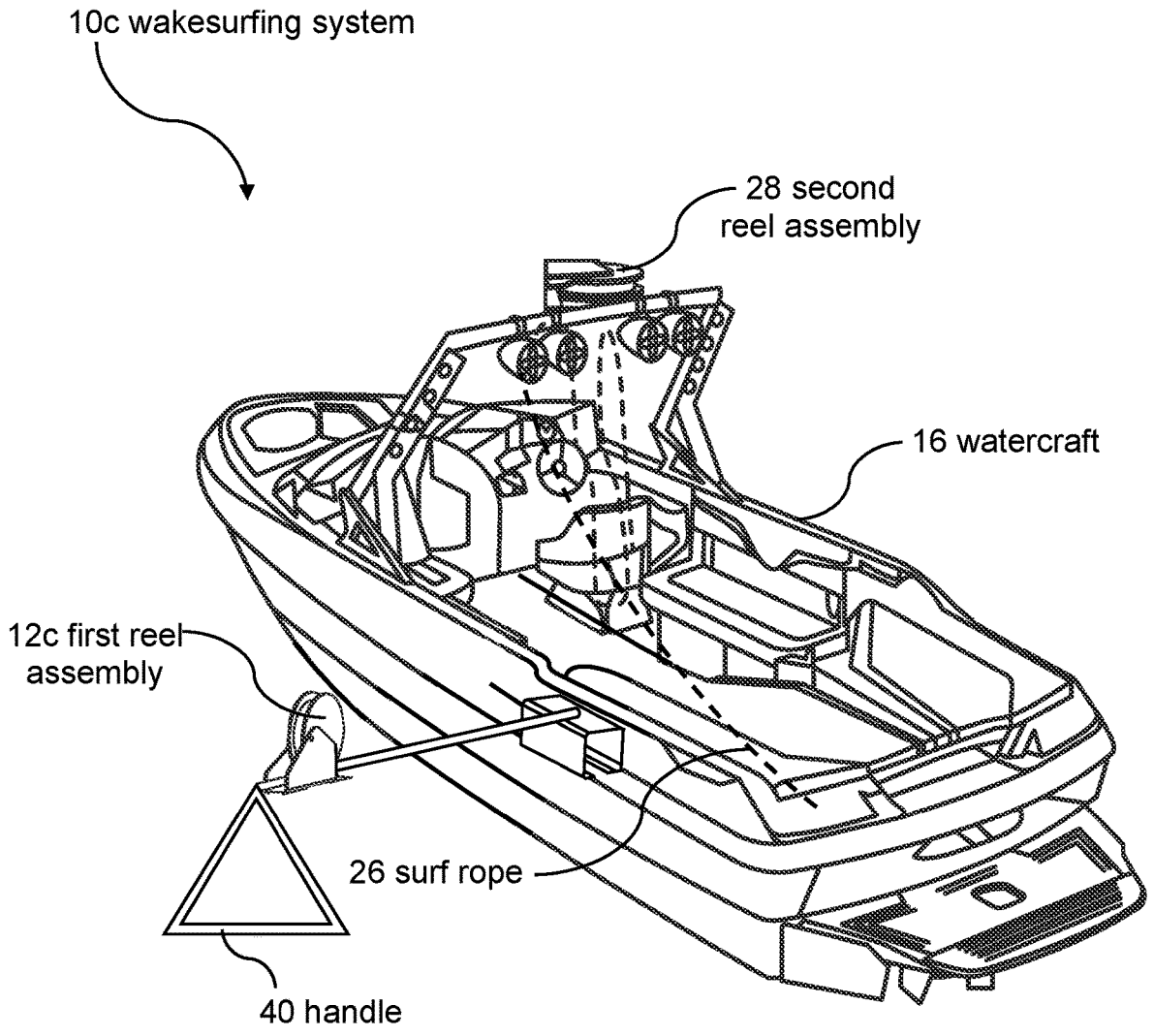

As shown in FIGS. 7-9, the system 10 may be arranged and configured to position the first reel assembly 12 in a variety of locations on the watercraft 16. For example, as illustrated in FIG. 7, the system 10*a* may be configured whereby at least part of the first reel assembly 12*a*, e.g. the reel, is located at least partially within an interior or semi-enclosed portion of the watercraft 16. In this regard, the watercraft 16 may be designed with an aperture extending through the side 42 of the watercraft 16 and an on-board compartment for the first reel assembly 12*a*. It should be appreciated that any portion of the first reel assembly 12*a* may be located within the interior or semi-enclosed portion of the watercraft 16. Furthermore, as shown in FIG. 7, the first reel assembly 12*a* may be located along either side 42 of the watercraft, such as at first reel location 13*a* on a first side of the watercraft or 13*b* located on a second side of the watercraft.

Now with reference to FIG. 8, some embodiments may be designed similar to the embodiment shown in FIG. 7, but instead having the reel located at a distal end of the boom 50. In this regard, less of the first reel assembly 12*b* is located within the interior portion of the watercraft 16. Similar to the embodiment shown in FIG. 7, the first reel assembly 12*b* may be located along either side 42 of the watercraft 16, such as at first reel location 13*a* or 13*b*.

With reference to FIG. 9, the first reel assembly 12*c* may be implemented as a hybrid version of various embodiments described herein. As shown in FIG. 9, the first reel assembly 12*c* may be physically located in a similar arrangement as disclosed with regards to FIGS. 1-6, but instead having the reel located at a distal end of the boom 50.

Figure 10:
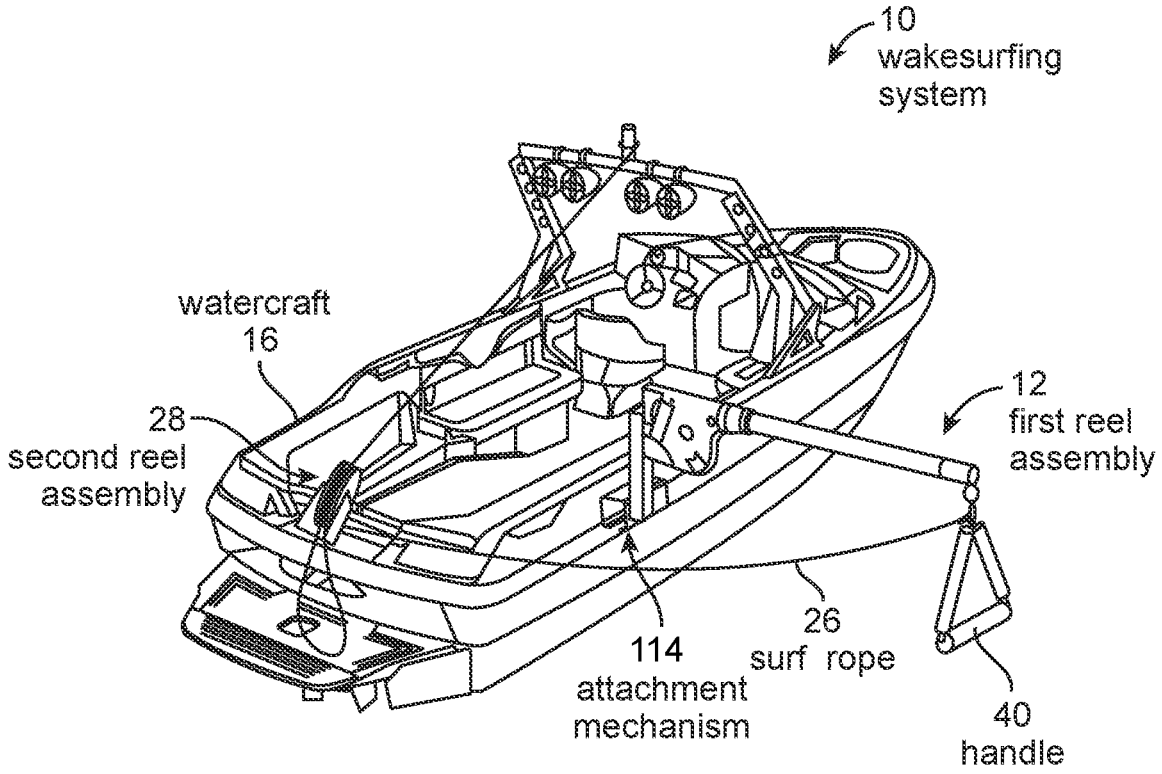
FIG. 10 illustrates a perspective view of a wakesurfing system wherein the reel cords and surf rope are in a retracted position, according to some embodiments.
Figure 11:
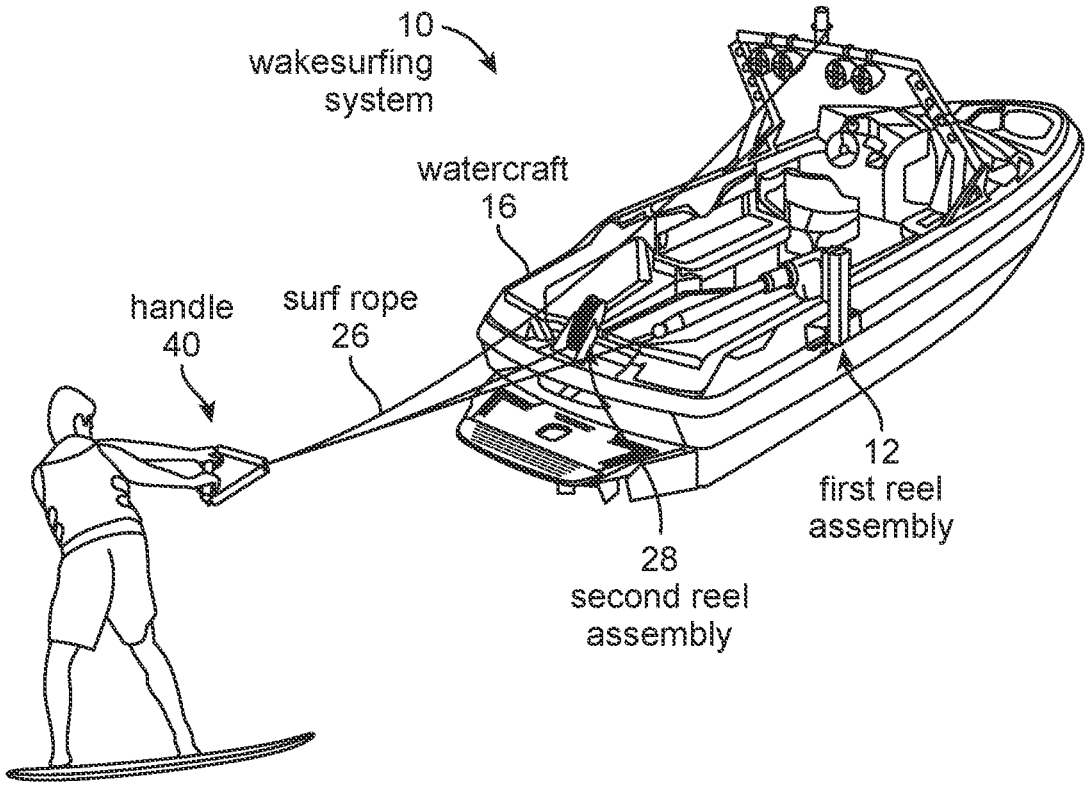
FIG. 11 illustrates a perspective view of a wakesurfing system wherein the reel cords and surf rope are in an extended position, according to some embodiments.

FIGS. 10 and 11 illustrate wakesurfing system 10. As shown, the system 10 may include a first reel assembly 12 and a second reel assembly 28, as well as a watercraft 16, a surf rope 26, and a handle 40. In some embodiments, the handle 40 comprises a triangle shape, but in other embodiments the handle 40 comprises any other suitable shape and/or form. In some embodiments, the watercraft 16 comprises a variety of boats and/or vessels suitable for water sports. According to some embodiments, the system 10 includes an attachment mechanism 114 for coupling the first reel assembly 12 to the watercraft 16. The attachment mechanism 114 may be a speed tow hook, at least one suction cup, hook-and-loop fasteners, a mounting plate, a trailering eye, ski pylon, or a swim platform. In some embodiments, the system 10 includes an attachment mechanism 114 for coupling the second reel assembly 28 to the watercraft 16.

Figure 12:
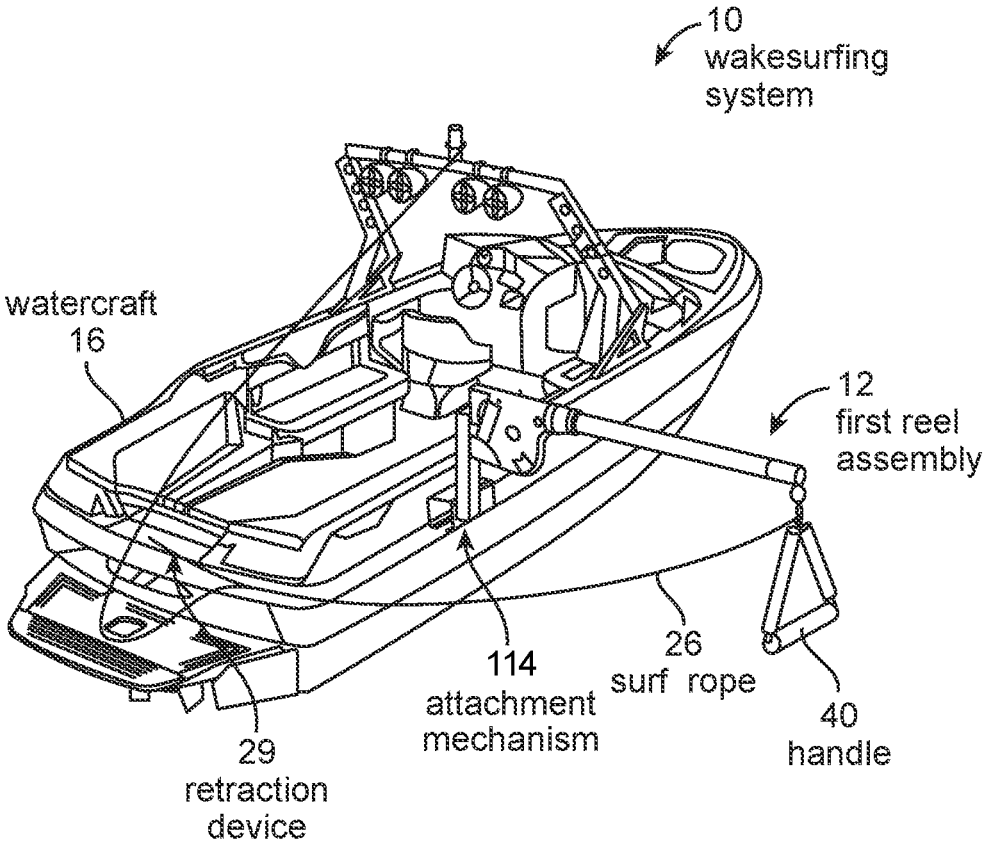
FIG. 12 illustrates a perspective view of a wakesurfing system wherein the reel cords and surf rope are in a retracted position, according to some embodiments.
Figure 13:
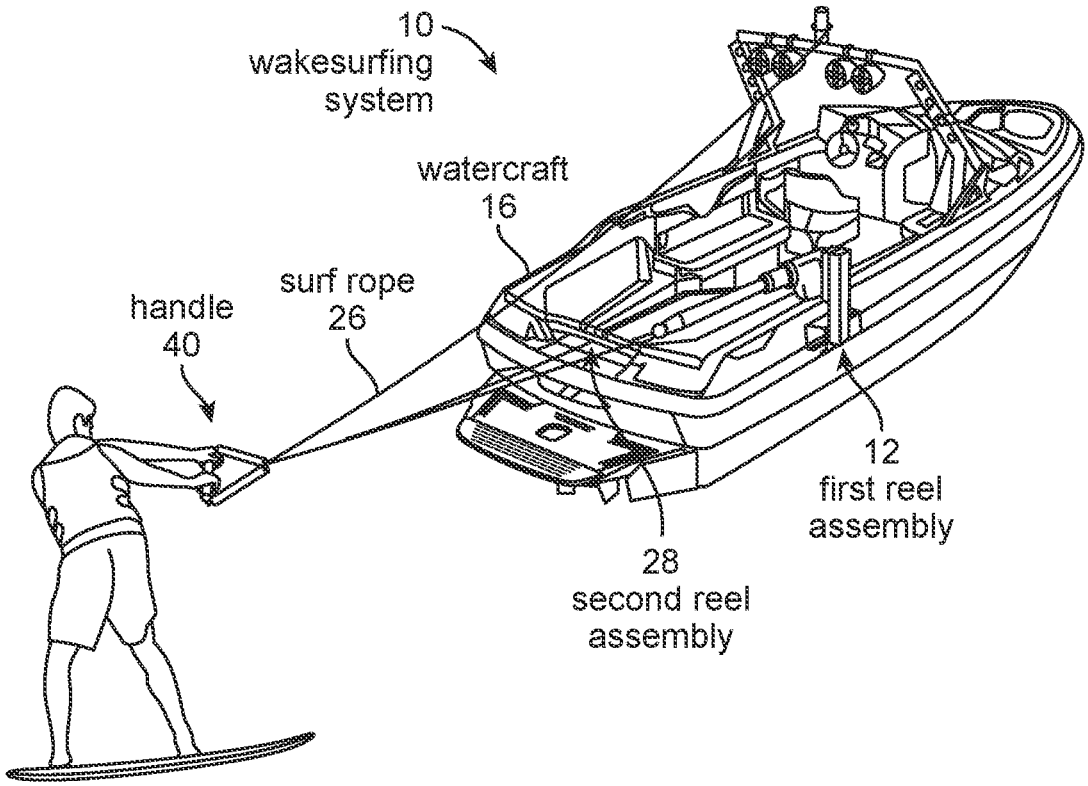
FIG. 13 illustrates a perspective view of a wakesurfing system wherein the reel cords and surf rope are in an extended position, according to some embodiments.

FIGS. 12 and 13 illustrate wakesurfing system 10. As shown, the system 10 may include a first reel assembly 12 and a retraction device 29, as well as a watercraft 16, a surf rope 26, and a handle 40. According to some embodiments, the retraction device 29 is a bungee cord. The retraction device 29 may also be a slack device. In some embodiments, the handle 40 comprises a triangle shape, but in other embodiments the handle 40 comprises any other suitable shape and/or form. In some embodiments, the watercraft 16 comprises a variety of boats and/or vessels suitable for water sports. According to some embodiments, the system 10 includes an attachment mechanism 114 for coupling the first reel assembly 12 to the watercraft 16. The attachment mechanism 114 may be a speed tow hook, at least one suction cup, hook-and-loop fasteners, a mounting plate, a trailering eye, ski pylon, or a swim platform. In some embodiments, the system 10 includes an attachment mechanism 114 for coupling the retraction device 29 to the watercraft 16.

Figure 14:
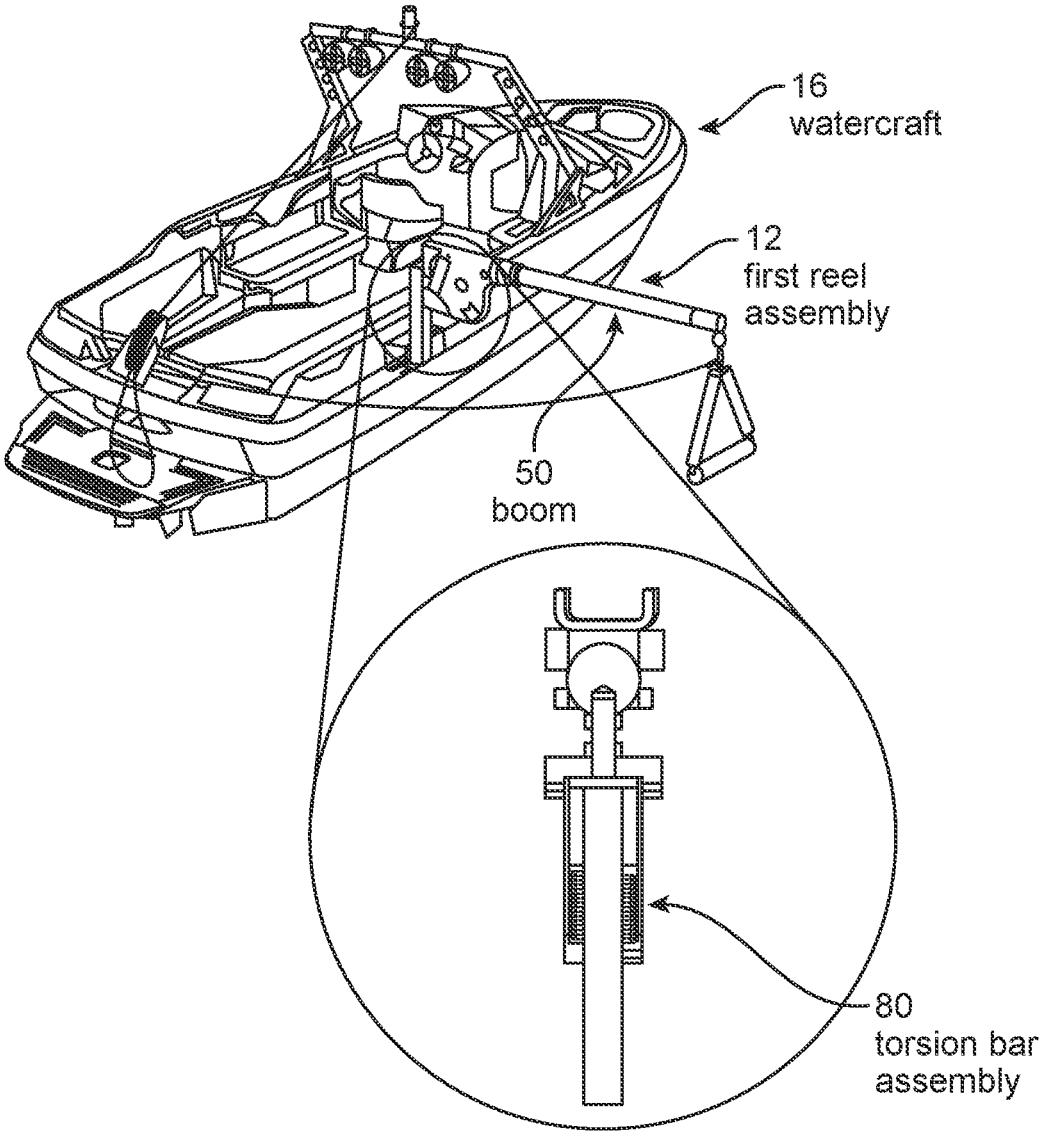
FIG. 14 illustrates a front perspective of a torsion bar that connects the reel cord and the boat, according to some embodiments.

With reference to FIG. 14, the first reel assembly 12 may comprise a torsion bar assembly 80 to allow the first reel assembly 12 freedom to rotate about the vertical axis so that the first reel assembly 12 and the boom 50 may point either at least partially perpendicular to the watercraft 16 or at least partially parallel to the watercraft 16 in a direction facing the rear 44 of the watercraft 16. In some embodiments, the torsion bar assembly 80 brings the boom 50 back to its starting position from its rotated position during use. According to some embodiments, the torsion bar assembly 80 prevents the boom 50 from rotating further toward the front of the watercraft 16 than the starting position.

Figure 15:
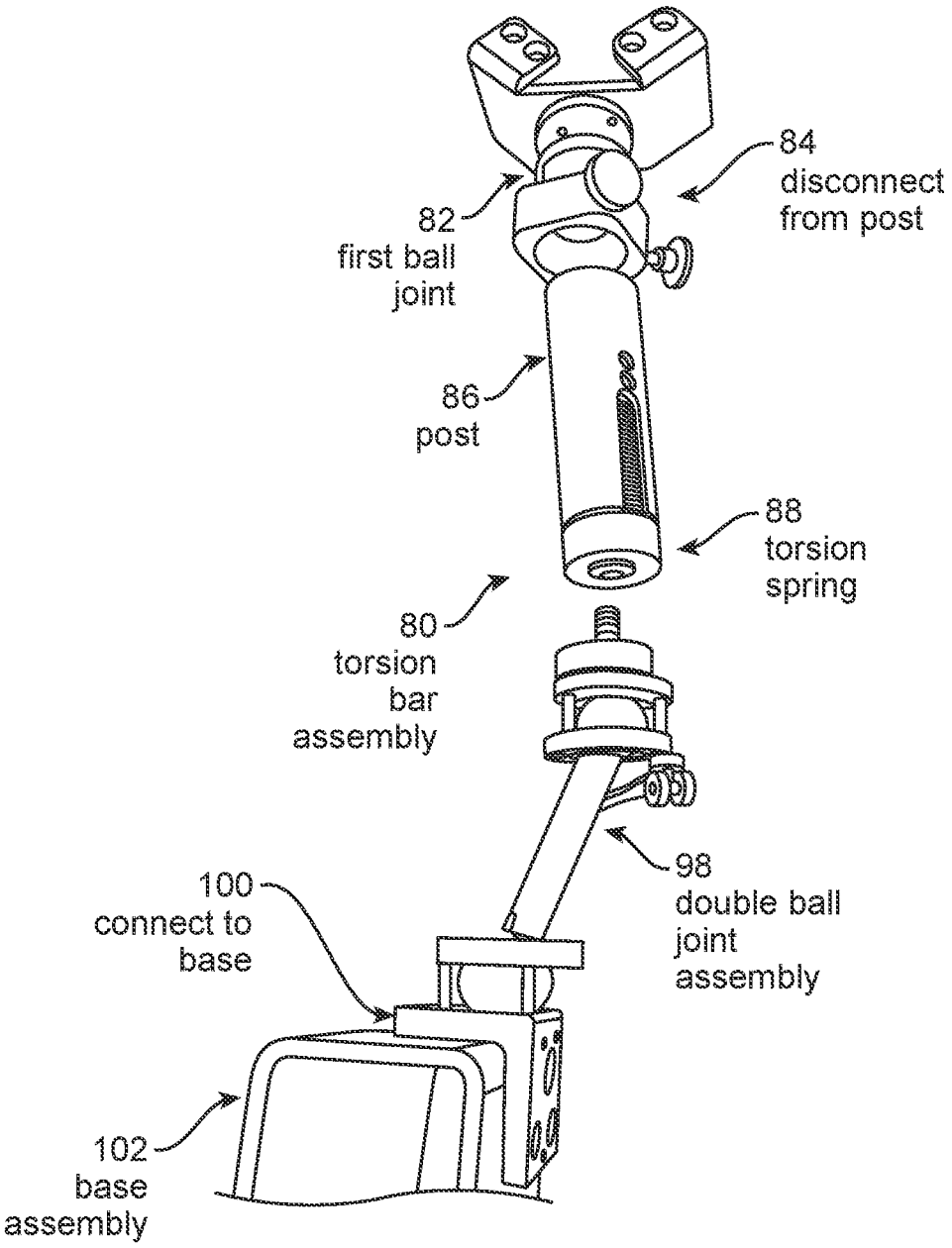
FIG. 15 illustrates an exploded side view of a torsion bar assembly, according to some embodiments.

As displayed in FIG. 15, in some embodiments a torsion bar assembly 80 comprises a first ball joint 82 coupled to a quick disconnect from post 84. According to some embodiments, the quick disconnect from post 84 couples to a post 86. The post 86 may comprise a torsion spring 88. In some embodiments, the post 86 couples to a double ball joint assembly 98 through the use of a threaded rod. According to some embodiments, the double ball joint assembly 98 couples to a quick connect to base 100. The quick connect to base 100 may couple to a base assembly 102.

Figure 16:
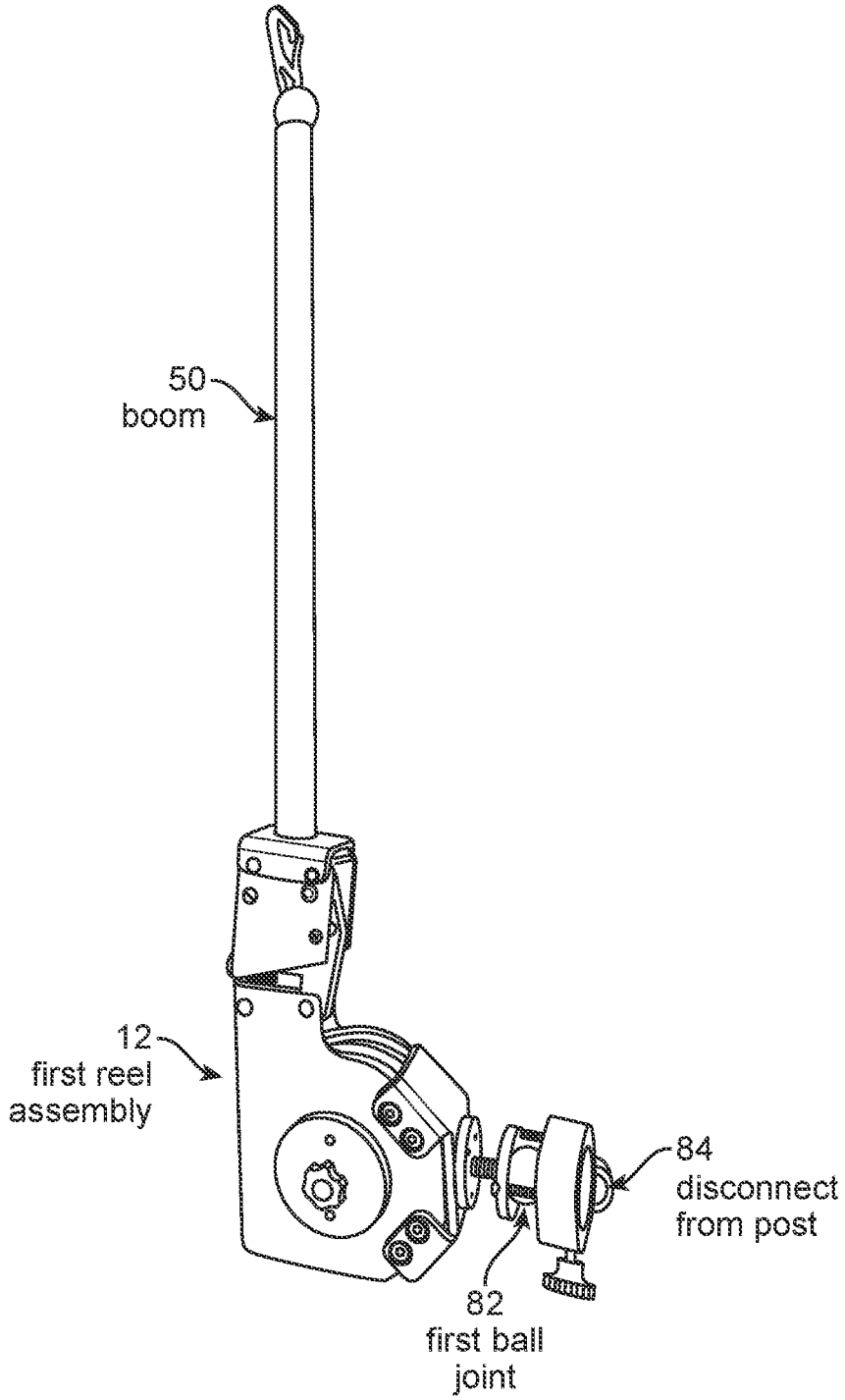
FIG. 16 illustrates a side view of a first reel assembly and boom coupled to a first ball joint, according to some embodiments.
Figure 17:
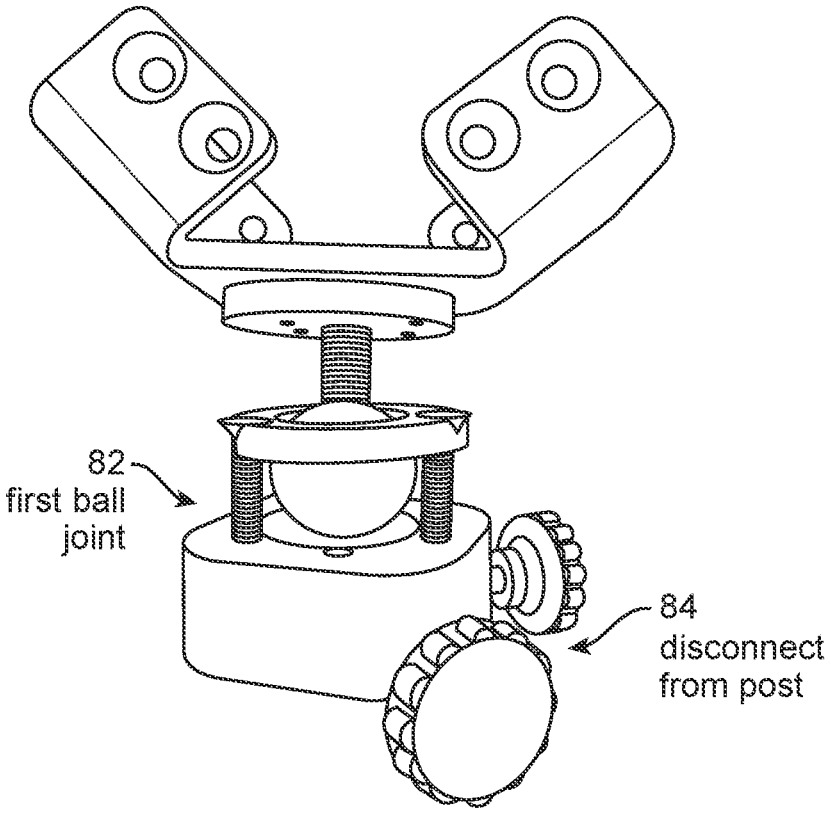
FIG. 17 illustrates a side view of a first ball joint connected to a quick disconnect from post, according to some embodiments.

FIGS. 16 and 17 shows the first reel assembly 12 and boom 50 which may be coupled to the first ball joint 82. In some embodiments, the first ball joint 82 is coupled to the quick disconnect from post 84.

Figure 18:
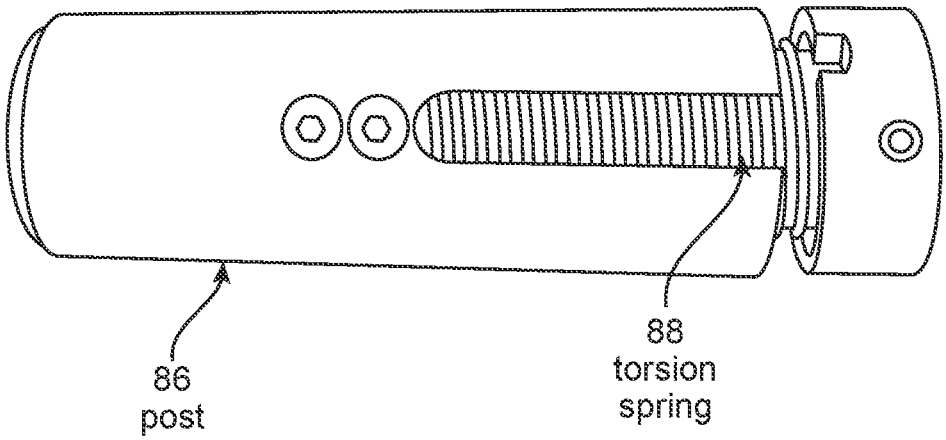
FIG. 18 illustrates a side view of a post comprising a torsion spring, according to some embodiments.
Figure 19:
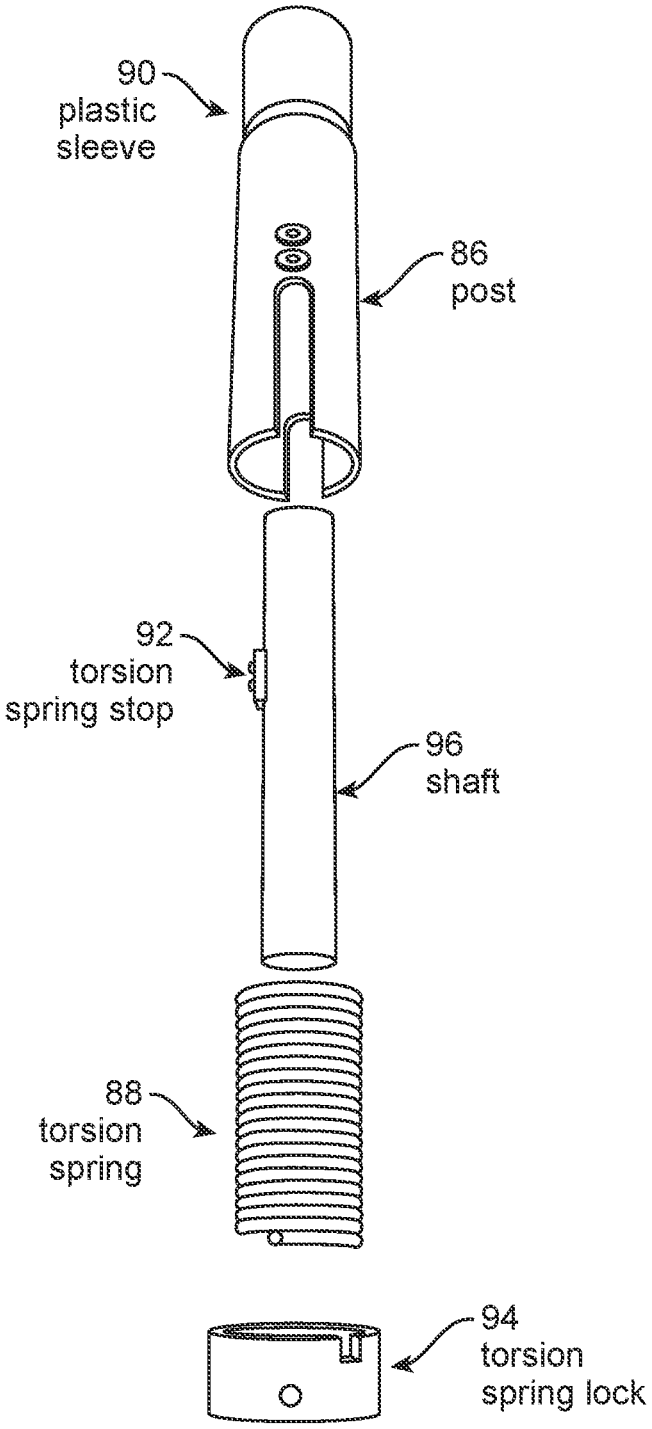
FIG. 19 illustrates an exploded side view of a post comprising a torsion spring, according to some embodiments.

As shown in FIGS. 18 and 19, the post 86 may comprise a torsion spring 88. In some embodiments, the post 86 comprises a plastic sleeve 90 which couples to a shaft 96 within the post 86. The shaft 96 may comprise a torsion spring stop 92. According to some embodiments, the torsion spring 88 makes contact with the torsion spring stop 92 to prevent the torsion spring 88 from entering the post 86 too deep. The torsion spring 88 may couple to a torsion spring lock 94 which may lock the torsion spring 88 in place.

Figure 20:
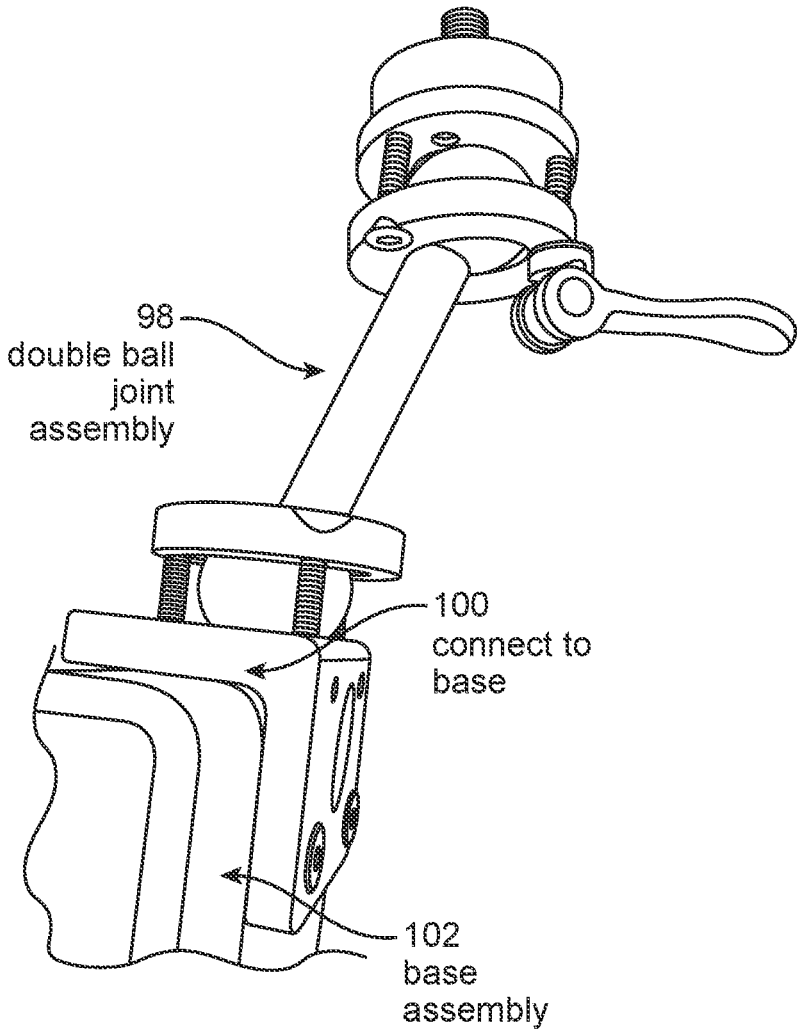
FIG. 20 illustrates a side view of a double ball joint assembly coupled to a base, according to some embodiments.

FIG. 20 shows the double ball joint assembly 98, which may couple to the quick disconnect to base 100. In some embodiments, the quick disconnect to base 100 couples to the base assembly 102.

Figure 21:
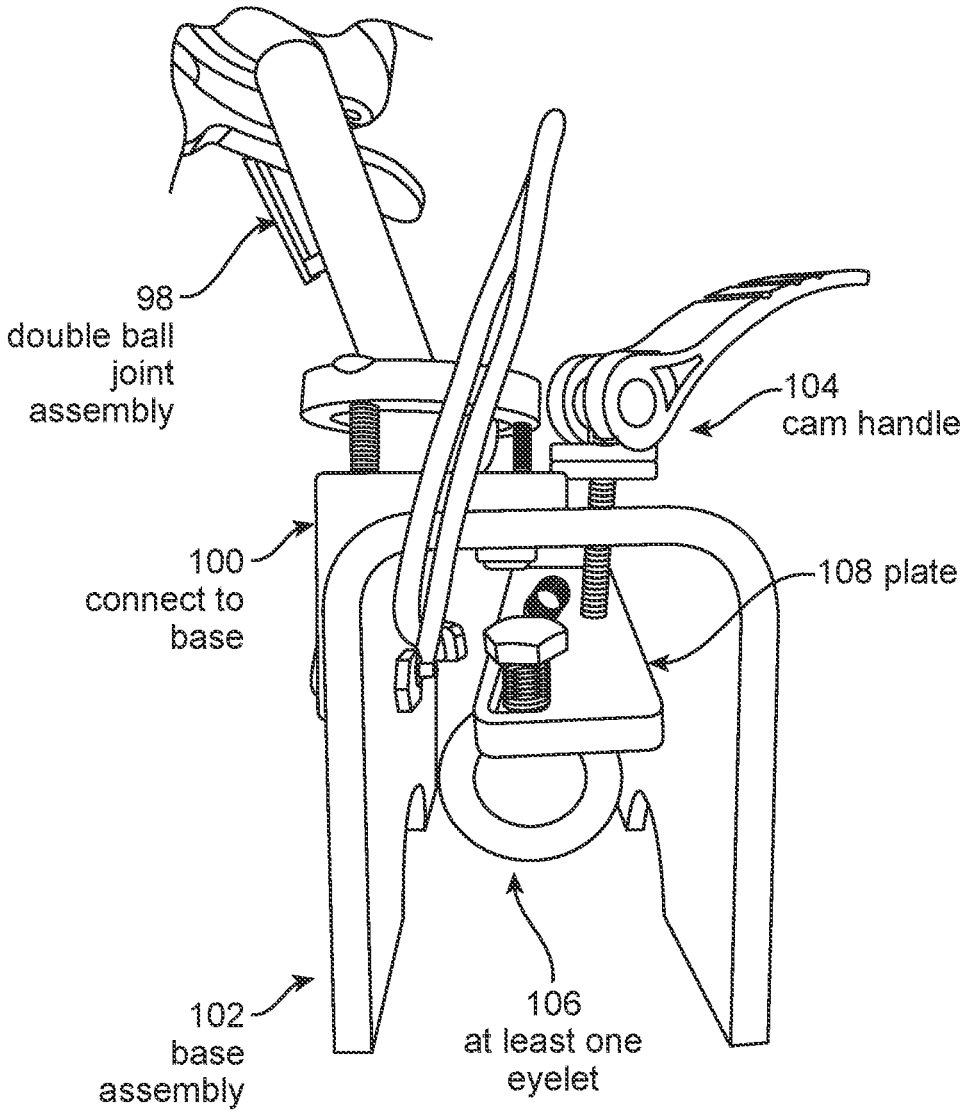
FIG. 21 illustrates a side view of a cam handle coupled to a plate through a base, according to some embodiments.

As displayed in FIG. 21, the double ball joint assembly 98 may couple to the quick connect to base 100 which may couple to the base assembly 102. In some embodiments, a cam handle 104 couples to a plate 108 through the base assembly 102. According to some embodiments, at least one eyelet 106 is coupled to the plate 108. The cam handle 104 may be threaded to couple to the plate 108.

Figure 22:
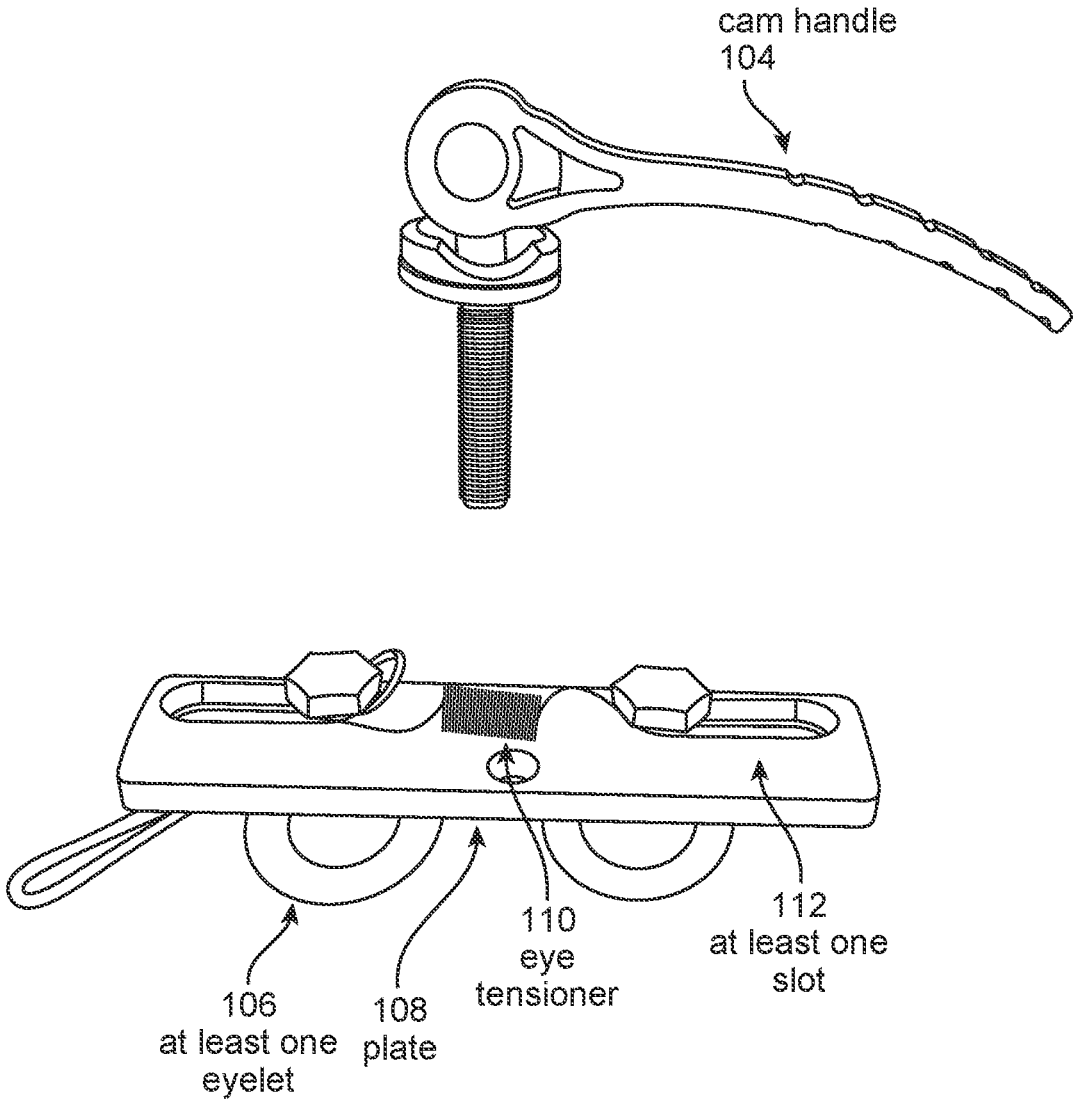
FIG. 22 illustrates an exploded side view of a cam handle and a plate comprising at least one eyelet, according to some embodiments.
Figure 23:
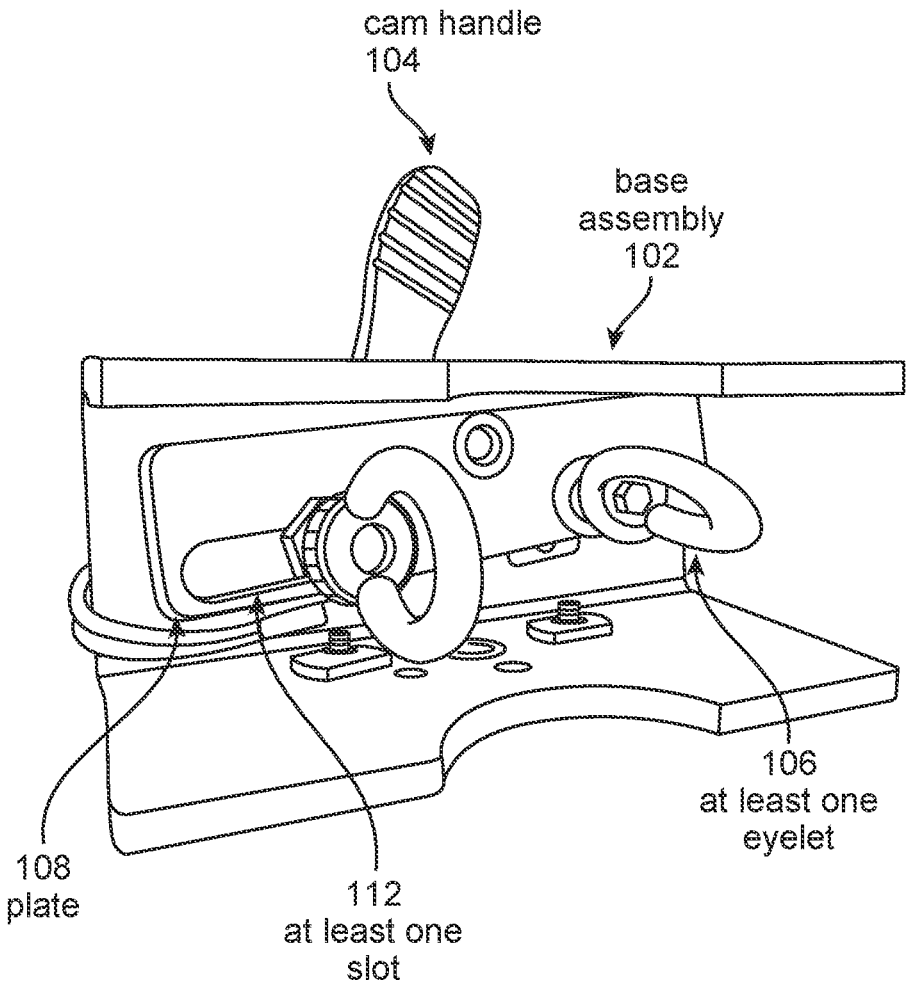
FIG. 23 illustrates a bottom perspective view of a cam handle coupled to a plate through a base, according to some embodiments.

Finally, FIGS. 22 and 23 display an embodiment where the plate 108 comprises at least one slot 112. The plate 108 may comprise an eye tensioner 110. In some embodiments, the eye tensioner 110 couples to the at least one eyelet 106 to hold the at least one eyelet 106 taught against the cleat 46. According to some embodiments, the at least one eyelet 106 at least partially passes through at least one slot 112 to couple to the plate 108. The cam handle 104 may pass through the base assembly 102 to couple to the plate 108.

Interpretation

Although certain embodiments and examples are disclosed above, inventive subject matter extends beyond the specifically disclosed embodiments to other alternative embodiments and/or uses, and to modifications and equivalents thereof. Thus, the scope of the claims appended hereto is not limited by any of the particular embodiments described above. The structures, systems, and/or devices described herein may be embodied as integrated components or as separate components. Furthermore, various omissions, substitutions, and changes in the form of the methods and systems described herein may be made without departing from the spirit of the inventions disclosed herein.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy. Furthermore, the phrase "at least one of" may be used as a shorthand way of saying "and/or". In this regard, the phrase "at least one of" may mean the same thing as "and/or".

The term "about" is used to mean approximately, and is not intended as a limiting term. For example, claim 14 includes the phrase "wherein the boom defines a length of about 4 feet" and in this context, "about" is not intended to limit the length of the boom to exactly four feet. In this regard, the phrase "wherein the boom defines a length of about 4 feet" may be interpreted to mean that the boom ranges from 3.75 feet to 4.25 feet.

What is claimed is:

1. A wakesurfing system, comprising:

a torsion bar assembly;

a reel assembly arranged and configured to couple to a watercraft via the torsion bar assembly;

a reel cord having a first end arranged and configured to couple to the reel assembly and a second end arranged and configured to couple to a distal location of a surf rope; and a boom coupled to the reel assembly, wherein the boom is arranged and configured to allow the reel cord to pass through an internal portion of the boom and offset the first end from the reel assembly and away from a side of the watercraft.

2. The wakesurfing system of claim 1, wherein the torsion bar assembly is arranged and configured to extend vertically from a first location on the watercraft, thereby creating a vertical axis extending from the first location on the watercraft, and wherein the reel assembly is configured to rotate about the vertical axis of the torsion bar assembly.

3. The wakesurfing system of claim 2, wherein the torsion bar assembly further comprises:

a first ball joint configured to rotate about the vertical axis of the torsion bar assembly;

a post coupled to the first ball joint;

a disconnect operably coupled to the first ball joint and detachably coupled to the post, whereby the disconnect is configured to detach the first ball joint from the post;

a double ball joint assembly coupled to the post on an end opposite that of the first ball joint, configured to rotate about the vertical axis of the torsion bar assembly;

a base assembly coupled to the double ball joint assembly on an end opposite that of the post; and a connect operably coupled to the double ball joint assembly and detachably coupled to the base assembly, whereby the connect is configured to attach the double ball joint assembly to the base assembly.

4. The wakesurfing system of claim 3, wherein the post further comprises:

a plastic sleeve configured to be inserted into the post;

a shaft configured to be inserted into the post on an end opposite that of the plastic sleeve, wherein the shaft comprises a torsion spring stop;

a torsion spring configured to be inserted into the post at least partially about the shaft and configured to stop entering the post when making contact with the torsion spring stop; and a torsion spring lock configured to lock the torsion spring in place and couple to the post.

5. The wakesurfing system of claim 3, wherein the base assembly further comprises:

a cam handle configured to be inserted through the base assembly;

a plate coupled to the cam handle, wherein the plate comprises at least one slot;

at least one eyelet coupled to the plate through the at least one slot, wherein the at least one eyelet is arranged and configured to couple to a cleat of the watercraft; and an eye tensioner configured to pull the at least one eyelet inward toward a center of the plate, thereby putting tension on the at least one eyelet arranged and configured to couple to the cleat to hold the base assembly at least partially in place.

6. The wakesurfing system of claim 1, wherein the reel assembly is a first reel assembly coupled to a first location on the watercraft, and wherein the reel cord is a first reel cord, the wakesurfing system further comprising:

a second reel assembly arranged and configured to couple to a second location on the watercraft; and a second reel cord having a first end arranged and configured to couple to the second reel assembly and a second end arranged and configured to couple to a proximal location of the surf rope.

7. The wakesurfing system of claim 6, wherein the distal location of the surf rope is located adjacent to a handle of the surf rope, and wherein the proximal location is between the distal location and the second reel assembly.

8. The wakesurfing system of claim 6, wherein the first reel assembly and the second reel assembly are arranged and configured to retract during and after a rider releases the surf rope.

9. The wakesurfing system of claim 8, wherein when the watercraft is located in a body of water, the second reel assembly is arranged and configured to retract the proximal location of the surf rope back so that the proximal location is adjacent the second reel assembly and that the surf rope is not located in the body of water along a side or rear surface of the watercraft.

10. The wakesurfing system of claim 6, wherein the first reel assembly is arranged and configured to rotate along a first axis and the second reel assembly is arranged and configured to rotate along a second axis that is different than the first axis.

11. The wakesurfing system of claim 7, further comprising a retraction device arranged and configured to couple to a second location on the watercraft.

12. The wakesurfing system of claim 11, wherein the first reel assembly and the retraction device are arranged and configured to retract after a rider releases the surf rope.

13. The wakesurfing system of claim 12, wherein the first reel assembly is arranged and configured to retract the handle back so that the handle is adjacent the first reel assembly after the rider releases the surf rope.

14. The wakesurfing system of claim 12, wherein when the watercraft is located in a body of water, the retraction device is arranged and configured to retract the proximal location of the surf rope back so that the proximal location is adjacent the second location on the watercraft and that the surf rope is not located in the body of water along a side or rear surface of the watercraft.

15. The wakesurfing system of claim 6, wherein the first location is a cleat located on the watercraft and the second location is located at a rear of the watercraft.

16. The wakesurfing system of claim 1, wherein the boom comprises one or more guides located along a length of the boom to thereby guide the reel cord through the boom.

17. The wakesurfing system of claim 16, wherein the boom comprises one or more rollers located at a distal end of the boom to thereby guide the reel cord out and away from the distal end of the boom.

18. The wakesurfing system of claim 1, wherein the boom is arranged and configured to offset the first end from the reel assembly and away from a side of the watercraft.

19. The wakesurfing system of claim 1, wherein the reel assembly is arranged and configured to rotatably couple to the watercraft.

20. The wakesurfing system of claim 1, wherein the boom is arranged and configured to telescope such that when the boom is in an elongated position the boom defines a first length and when the boom is in a retracted position the boom defines a second length that is shorter than the first length.

* * * * *